US010864426B2

(12) United States Patent
Watson

(10) Patent No.: US 10,864,426 B2
(45) Date of Patent: Dec. 15, 2020

(54) GOLF SWING TRAINING AID ROD AND METHOD FOR GOLF SWING AND ARM CONTROL TRAINING

(71) Applicant: Edward Bates Watson, Dana Point, CA (US)

(72) Inventor: Edward Bates Watson, Dana Point, CA (US)

( * ) Notice: Subject to any disclaimer, the term of this patent is extended or adjusted under 35 U.S.C. 154(b) by 0 days.

(21) Appl. No.: 16/402,985

(22) Filed: May 3, 2019

(65) Prior Publication Data

US 2020/0346090 A1 Nov. 5, 2020

(51) Int. Cl.
*A63B 69/36* (2006.01)
*A63B 102/32* (2015.01)
*A63B 60/00* (2015.01)

(52) U.S. Cl.
CPC ..... *A63B 69/3608* (2013.01); *A63B 69/3621* (2020.08); *A63B 69/3632* (2013.01); *A63B 60/0085* (2020.08); *A63B 2102/32* (2015.10); *A63B 2230/62* (2013.01)

(58) Field of Classification Search
USPC ..... 473/207, 208, 212–216, 219, 227, 266, 473/276, 458
See application file for complete search history.

(56) References Cited

U.S. PATENT DOCUMENTS 5,465,971 A * 11/1995 Tischler ..... A63B 69/3685 473/227
5,529,306 A * 6/1996 Staats ..... A63B 69/0059 473/208
5,919,097 A * 7/1999 Cole ..... A63B 69/3608 434/252
5,954,598 A * 9/1999 Carlson ..... A63B 24/0021 473/458
7,033,282 B1 * 4/2006 Flood ..... A63B 69/0059 473/219
7,033,284 B2 * 4/2006 Yoshimura ..... A63B 69/3608 473/212
7,578,773 B2 * 8/2009 Gronda ..... A63B 21/00069 482/111
7,740,544 B2 * 6/2010 Williams ..... A63B 69/3608 473/212
8,562,451 B2 * 10/2013 Crabtree ..... A63B 69/3608 473/215
9,715,869 B1 * 7/2017 Sorenson ..... F16M 11/28
2005/0236450 A1 * 10/2005 Iannini ..... B63B 32/80 224/577
2008/0176665 A1 * 7/2008 Snyders ..... A63B 69/3623 473/216
2019/0192943 A1 * 6/2019 McLendon ..... A63B 69/3641

* cited by examiner

*Primary Examiner* — Nini F Legesse

(57) ABSTRACT

The present invention relates to a golf swing training aid rod for teaching a golfer the proper golf swing and arm control for execution a golf stroke. In particular, the golf swing training aid rod includes an elongated shaft having a reference tip located at a first end of the elongated shaft and an attachment member located at a second end of the elongated shaft, and an axilla support member having an axilla side, an inner bicep side, and an attachment receiving member, the attachment receiving member is coupled to the attachment member of the elongated shaft, the axilla support member is configured to be inserted and held in place between an inner bicep and an axilla member of the golfer, and the golf swing training aid rod provides the visual and tactile feedback to the golfer while executing the golf stroke.

17 Claims, 26 Drawing Sheets

101B

101B

101B

101B

GOLF SWING TRAINING AID ROD AND METHOD FOR GOLF SWING AND ARM CONTROL TRAINING

FIELD OF THE INVENTION

The present invention relates to a golf swing training aid rod for teaching a golfer proper golf swing and arm positioning techniques. In particular, the golf swing training aid rod includes a shaft member attached to an axilla support member for providing both a visual and tactile feedback to correctly position the arms of the golfer while executing a golf stroke.

BACKGROUND

Several conventional golf training aid devices exist to help a golfer improve their golf swing, thereby improving the stability and accuracy of the golfer's swing. Some of these training aid devices are designed to be attached to club grips of golf clubs, while other devices may be worn by the golfer.

Among other golf grip and swing techniques, a golf swing takeaway may be one of the key elements of the swing that can ruin the rest of the motion if not executed properly. Most beginner golfers are generally prone to make mistake in the golf swing takeaway that may lead to further swing plane errors in the backswing, resulting and adversely affecting downswing stroke and further contributing to impact problems.

Since both arms play a critical role in determining the swing plane, improper arm positioning, control and alignment during golf swing can exacerbate and further enhance the swing plane errors. For example, during the golf swing, the straight leading arm generally provides the power while the trailing arm may provide the direction control. How the leading arm is flexed and the distance of the elbow of the trailer arm is away from the side of the body may dictate the swing plane. Thus, poor arm control and position can often lead to poor or improper golf swings resulting in reduced accuracy and power.

Although some golf training devices aid in improving posture and swing rotation, there is a need for golf training devices that assist in teaching the golfer proper arm positioning and control for reducing swing plane errors and improving the golf swing motion, accuracy and power of the golfer.

SUMMARY

It is an advantage of the present invention to provide a golf swing training aid rod for teaching a golfer a proper golf swing and positioning of a leading arm and a trailing arm of the golfer through visual and tactile feedback having an elongated shaft having a reference tip located at a first end of the elongated shaft and an attachment member located at a second end of the elongated shaft, the first end is opposite to the second end; and an axilla support member having a disk-like body, an axilla side formed on a first side of the disk-like body, an inner bicep side formed on a second side of the disk-like body, and an attachment receiving member formed at one end of the disk-like body, the attachment receiving member is coupled to the attachment member of the elongated shaft, the axilla support member is configured to be applied to a pressure point formed between an inner bicep and an axilla member of the trailing arm of the golfer.

In one aspect, the elongated shaft may include telescoping members to extend or retract an overall length of the elongated shaft. In another aspect, the elongated shaft may include a rotating member coupling an upper portion of the elongated shaft to a fixed coupling member; the fixed coupling member may be coupled to the attachment receiving member. In yet another aspect, the elongated shaft may include a curved forearm rest support formed between two sections of the elongated shaft, the two sections include the fixed coupling member and a reference guide member.

In one embodiment, the elongated shaft may include an illumination component and a contact switch formed on the elongated shaft, the illumination component may be applied and secured to a tip end of the elongated shaft and the contact switch may be applied near a mid-point of the elongated shaft. In another embodiment, the axilla support member may include a flat body having a rounded regular polygon shape. In yet another embodiment, the axilla support member may include an oval shaped body and a curved surface.

In one implementation, the oval shaped body and curved surface of the axilla support member may have two sides including the inner bicep side and the axilla side. In another implementation, the inner bicep side may have an inward curved surface and the axilla side may have an outward curved surface to accommodate and complement the natural shape of the axilla member and inner bicep of the golfer. In yet another implementation, the axilla support member may include a foam pad coupled to the inner bicep side of the axilla support member.

In one example, the axilla support member may include a rotating ball joint connecting the attachment receiving member to the axilla support member; the rotating ball joint may provide a rotating mechanism that allows for fine tuning and adjustments to the elongated shaft. In another example, the axilla support member may include an arm band attachment. In yet another example, the axilla support member may include two arm band slots formed at each end of the axilla support member into which a portion of each end of the arm band attachment may be inserted and secured thereon.

In one configuration, the axilla support member may include a j-hook type axilla support member. In another configuration, the j-hook type axilla support member may include an axilla block coupled to a triceps rest attachment. In yet another configuration, the j-hook type axilla support member may include extendable members. In still yet another configuration, the axilla block of the j-hook type axilla support member may include a sliding axilla block coupled to a fixed axilla block via a connector bar.

These and other objects, features and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the embodiments of the invention and from the attached drawings, in which.

In the appended figures, one or more elements may have the same reference numeral in different figures indicating previously described elements.

DETAILED DESCRIPTION

Properly orientating and positioning a golf club can be challenging and difficult for many golfers. In a typical golf club design, the main parts of the golf club include a grip, a shaft, and a head. The head of the golf club has two sides known as a clubface and a back. In practice, the ideal is to get the clubface to a golf ball perpendicular at impact. With respect to the clubface, it may be difficult to achieve the proper swing of the clubface based on the chest rotation and alignment of the golfer at address and backswing positions.

Figure 1:
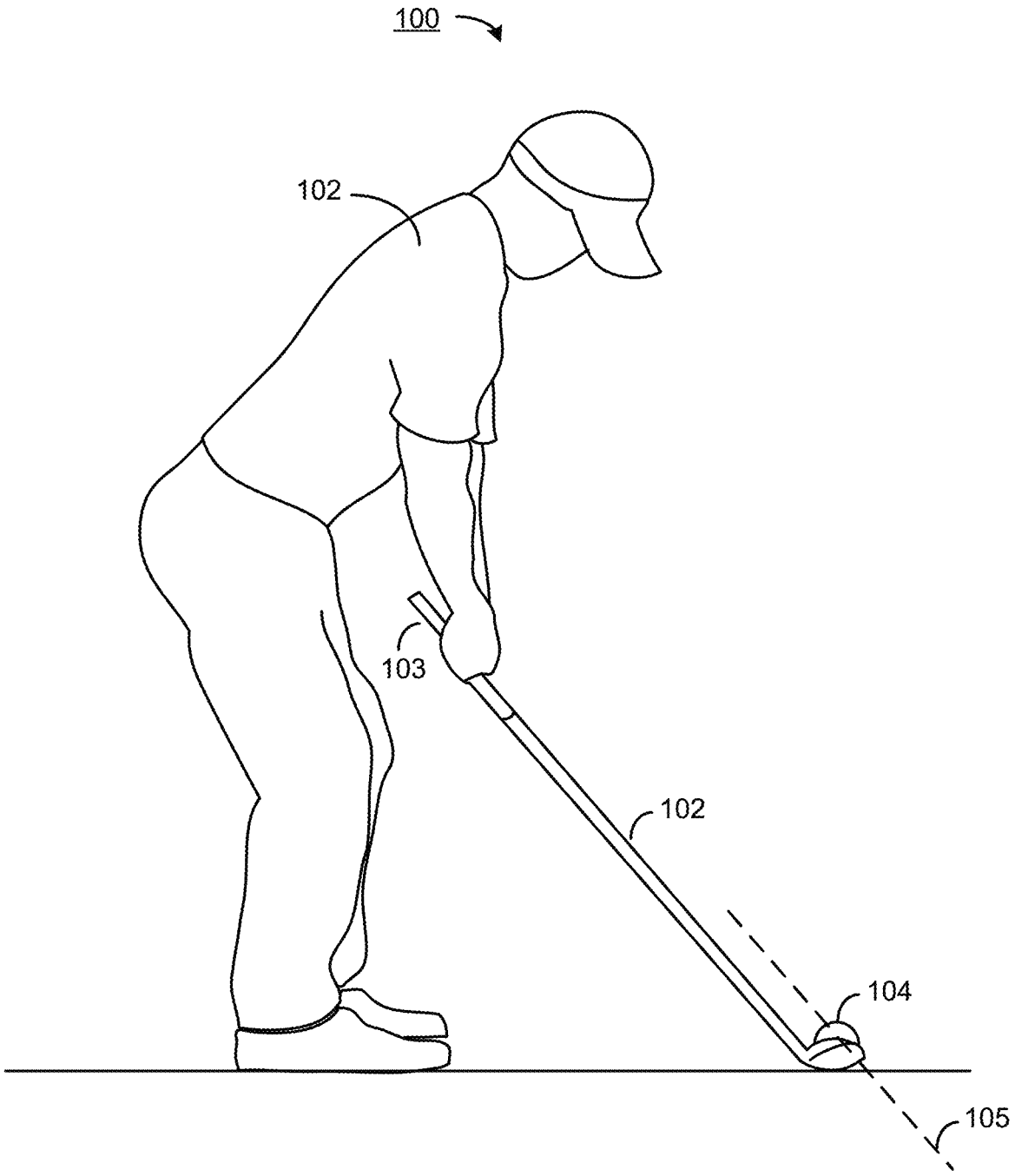
FIG. 1 illustrates a typical golfer with a golf club at address or starting position.

FIG. 1 illustrates a typical golfer 100 with a golf club 102 at address or starting position. At address position, the clubface of the golf club 102 is positioned on an imaginary target line. A golf ball 104 is placed along the imaginary target line 105 so that the clubface of the golf club 102 is substantially perpendicular to the golf ball prior to impact. In practice, the top of the grip 103 of the golf club points directly at the golfer 102 while the clubface points directly at the target line. Improper club handling techniques can and often leads to inconsistent and ineffective golf swings at impact. For example, bending or improperly rotating the chest while holding the golf club 102 may adversely affect the alignment and swing at impact. For example, applying a proper forward shaft lean and palming down techniques can significantly reduce improper swing at impact by keeping the clubface square to the golf ball. By applying these techniques, the chest, shoulders and hips are kept parallel with the target line 105 and the grip end of the golf club is pointed near the front center line 107 of the golfer 100, giving the golfer the proper swing at impact. In the foregoing embodiments, references are made to a leading arm and a trailing arm of the golfer 100. As defined herein, the leading arm is considered to be the straight arm that delivers power while the trailing arm is considered to be the arm which bends and provides the direction control during the golf swing.

Figure 2A:
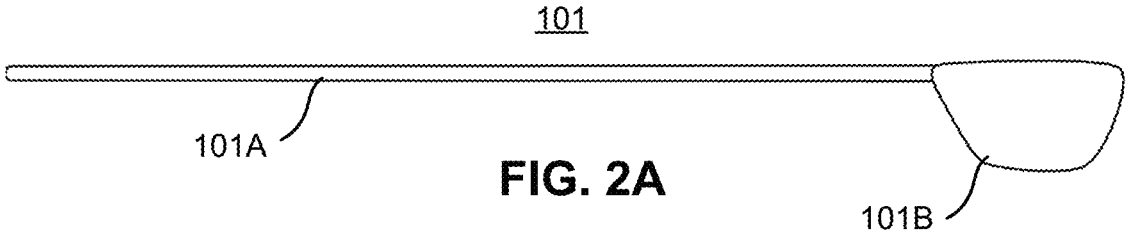
FIG. 2A-FIG. 2D illustrate a front view, side profile view, top view, and perspective view, respectively, of a golf swing training aid rod, according to an embodiment.
Figure 2B:
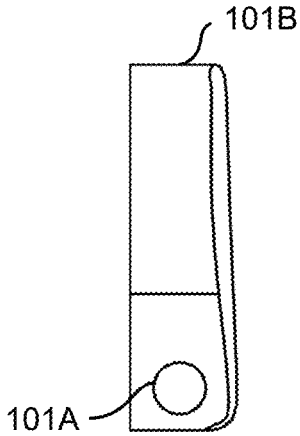
Figure 2C:
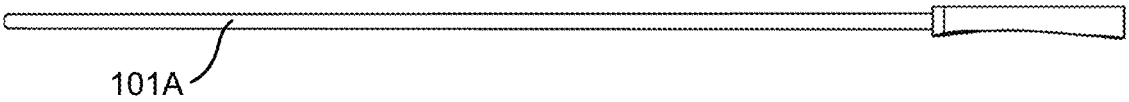
Figure 2D:
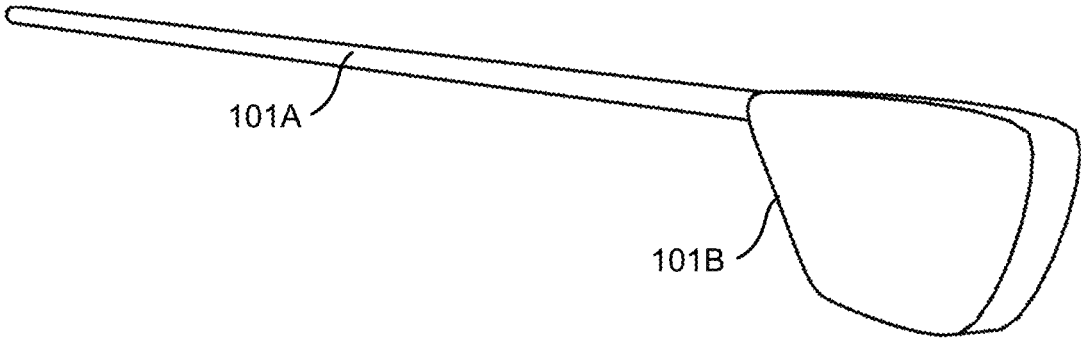

FIG. 2A-FIG. 2D illustrate a front view, side profile view, top view, and perspective view, respectively, of a golf swing training aid rod 101 according to an embodiment. The golf swing training aid rod 101 may include an elongated shaft 101A coupled to an axilla support member 101B. The elongated shaft 101A is generally a relatively long and narrow object such as, for example, a rod, stick or wand, made from lightweight durable materials such as wood, fiberglass, carbon fiber, and plastics or a combination thereof. Examples of structures forming and defining the elongated shaft 101A may include a cylindrical tube or rod, a rectangular tube or rod, or other non-linear shaped tubes or rods. In one implementation the elongate shaft 101A has a linear structure as shown in FIG. 2A. However, other configurations may be applied to the elongate shaft 101A as will be described and presented later herein below. Dimensionally, the elongate shaft 101A may be between 12"-36" in length having a width or thickness of approximately 0.25"-1". In practice, the elongate shaft 101A may be used as a visually reference guide and also provide tactile (touch) feedback to the leading arm of the golfer 100, teaching the golfer 100 proper arm control and the proper swing rotation of their golf stroke. Referring to FIG. 2B, the axilla support member 101B is generally a relatively small, thin and lightweight disk-like body being approximately 3"-6" in overall width, 3"-7" in overall length, and 0.125"-0.75" in thickness. In addition, the surface, shape and body of the axilla support member 101B may be complementary in shape to that of the axilla (armpit) of the golfer in order to provide an ergonomic, natural and snug fit when applied and held at a pressure point by the golfer, allowing the golfer to fully secure, support and apply sufficient tension to the golf swing training aid rod 101 while executing the golf stroke without causing muscle tightness or discomfort to the golfer.

Figure 3:
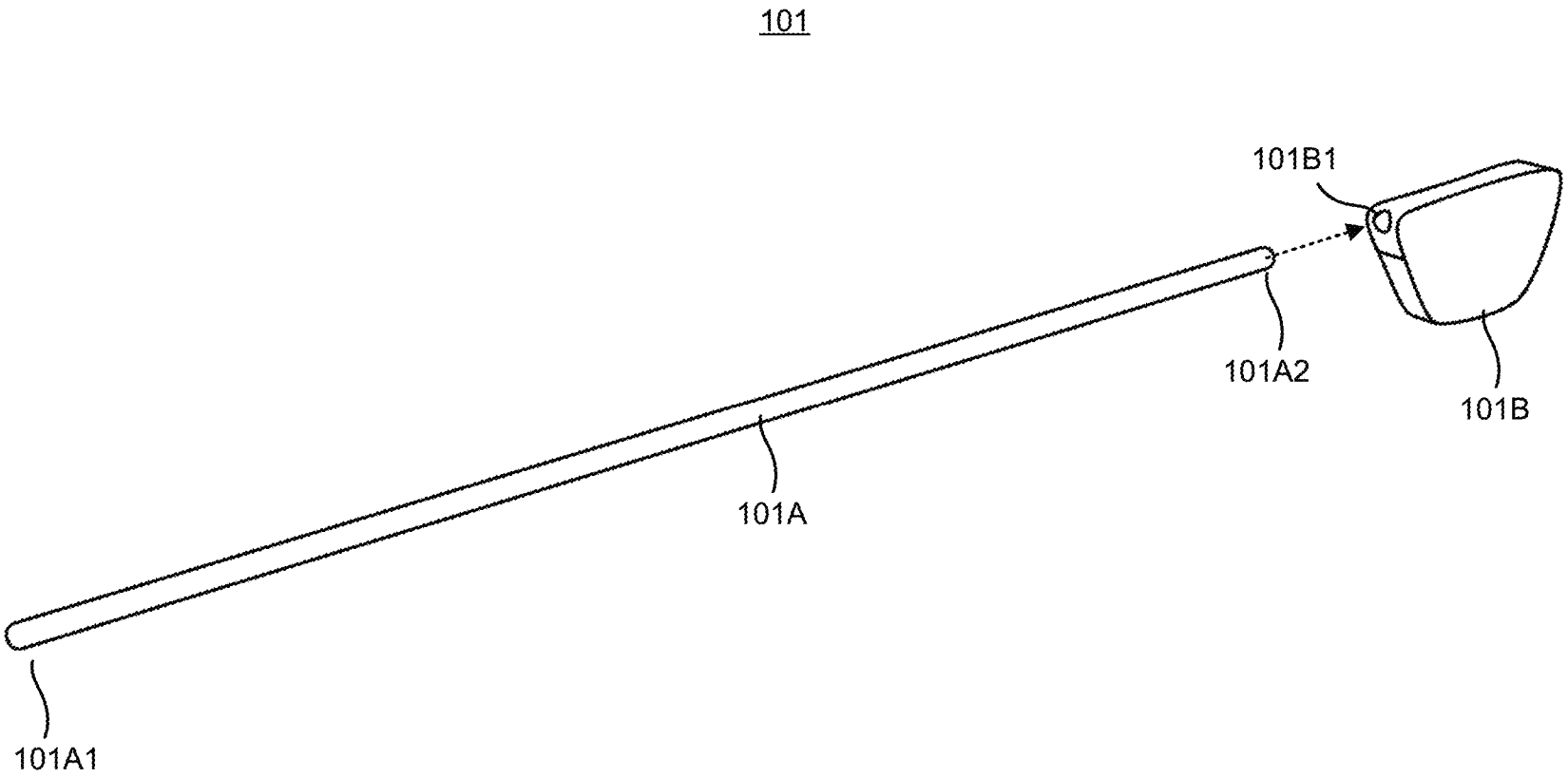
FIG. 3 illustrates an exploded view of the golf swing training aid rod, according to an embodiment.

FIG. 3 illustrates an exploded view of the golf swing training aid rod 101. In the exploded view, the elongated shaft 101A may include two parts: 1) a reference tip 101A1 and 2) an attachment member 101A2, while the axilla support member 101B may include an attachment receiving member 101B1 for receiving and securing the elongated shaft 101A to axilla support member 101B. Various attachment mechanisms for securing the elongated shaft 101A to the axilla support member 101B may include, for example, a threaded rod and threaded hole attachment, a quick disconnect attachment, and a twist lock attachment. In another implementation, the elongated shaft 101A and the axilla support member 101B may be permanently attached using a single mold to fabricate the golf swing training aid rod 101 as a unitary, single, and inseparable piece. Some fabrication techniques include, for example, plastic injection molding, 3D-printing, and laser etching and cutting techniques.

Figure 4A:
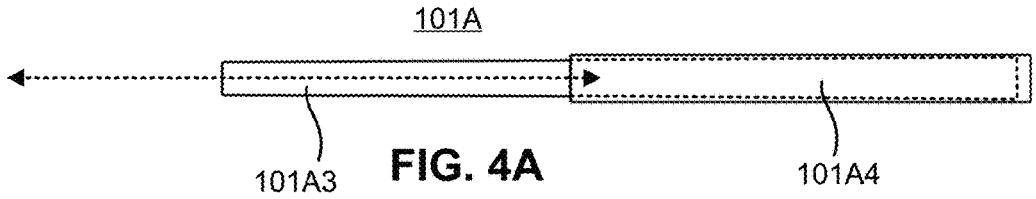
FIG. 4A-FIG. 4D illustrate multiple views of the elongated shaft having extension members to increase or decrease the length of the elongated shaft, according to an embodiment.
Figure 4B:
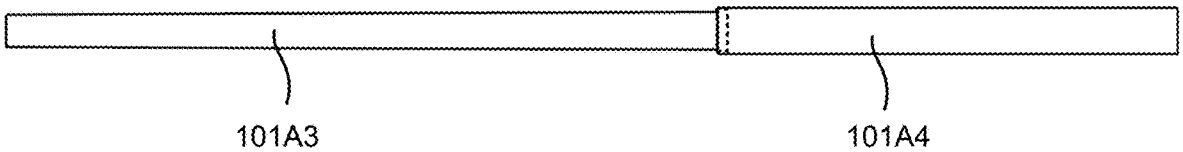
Figure 4C:
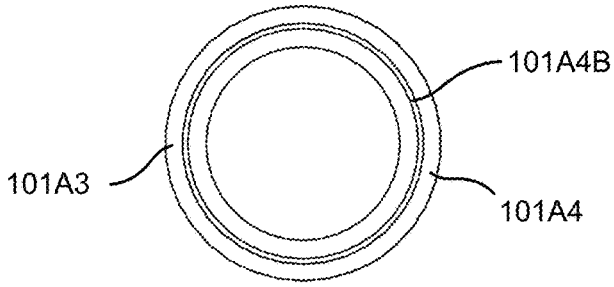
Figure 4D:
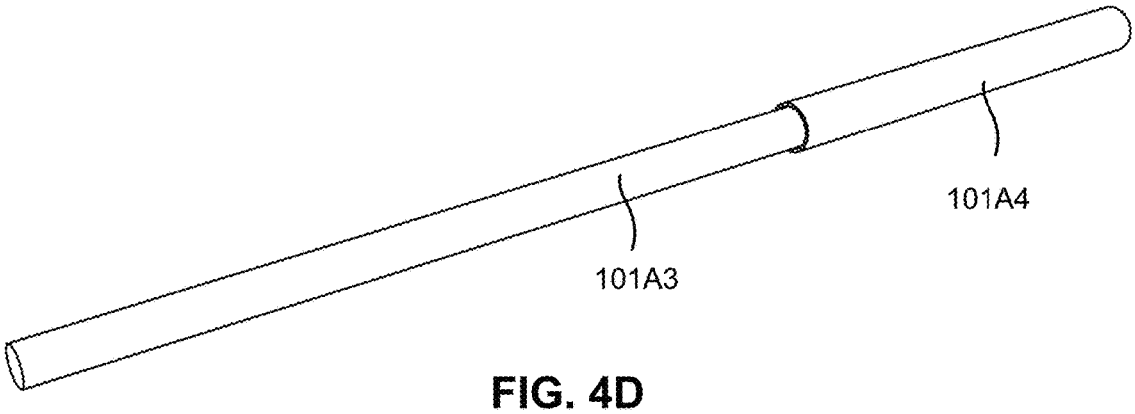
Figure 5A:
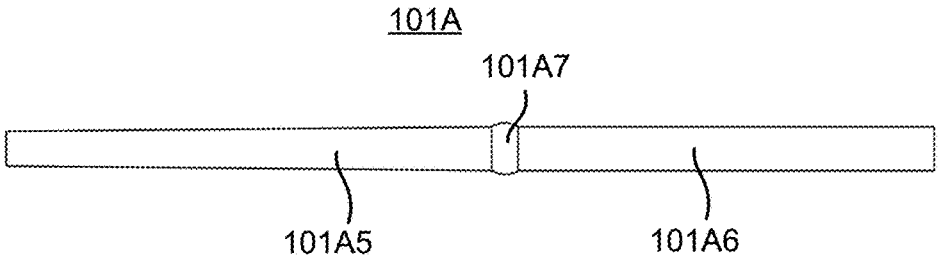
FIG. 5A-FIG. 5D illustrate multiple views of the elongated shaft having a rotating member along a rotating joint to rotate a portion of the elongated shaft and a fixed coupling member, according to an embodiment.
Figure 5B:
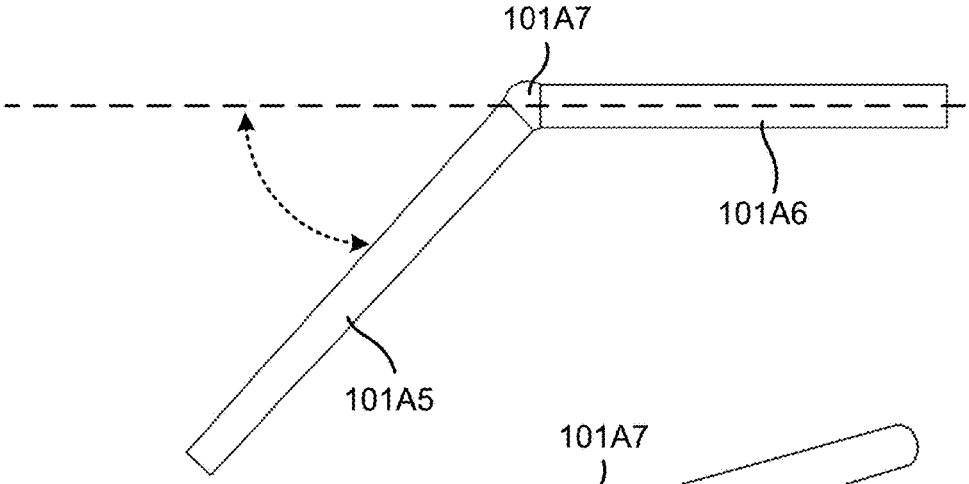
Figure 5C:
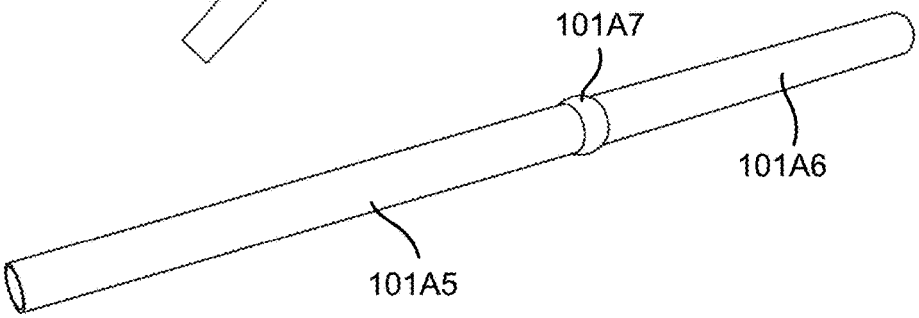
Figure 5D:
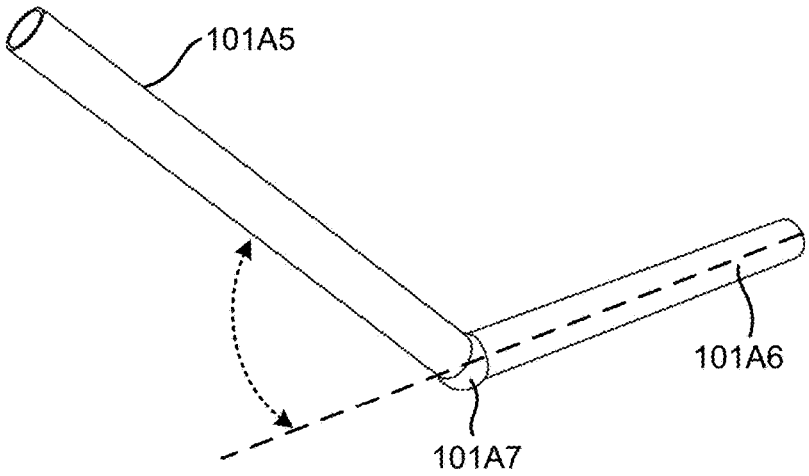

FIG. 4A-FIG. 4D illustrate multiple views of the elongated shaft 101A having extension members (101A3, 101A4) to increase or decrease the length of the elongated shaft 101A, according to an embodiment. For example, the elongated shaft 101A may be retracted by pushing a first extension member 101A3 towards the second extension member 101A4 to a minimum length as shown in FIG. 4A or extended by pulling the first extension member 101A3 from the second extension member 101A4 to a maximize length as shown in FIG. 4B. In one implementation, retracting and extending the first extension member 101A3 may be accomplished using a telescoping pole design where the second extension member 101A4 has a hollow interior 101A4B into which the first extension member 101A3 is inserted as shown in a cross-sectional view in FIG. 4C. In practice, the extension members (101A3, 101A4) of the elongated shaft 101A provides a mechanism that reduces the overall size of the golf swing training aid rod 101 and thereby making it compact, portable, and easy to carry or store in a golf bag.

FIG. 5A-FIG. 5D illustrate multiple views of the elongated shaft 101A having a rotating member 101A5 along a rotating joint 101A7 to rotate a portion of the elongated shaft 101A and a fixed coupling member 101A6, according to an embodiment. For example, the rotating member 101A5 of the elongated shaft 101A may rotate at the rotating joint 101A7 while the fixed coupling member 101A6 may be connected the axilla support member 101B. In practice, the rotating member 101A5 of the elongated shaft 101A allows adjustments to the elongated shaft 101A to provide a modified reference guide during the golf swing.

Figure 6A:
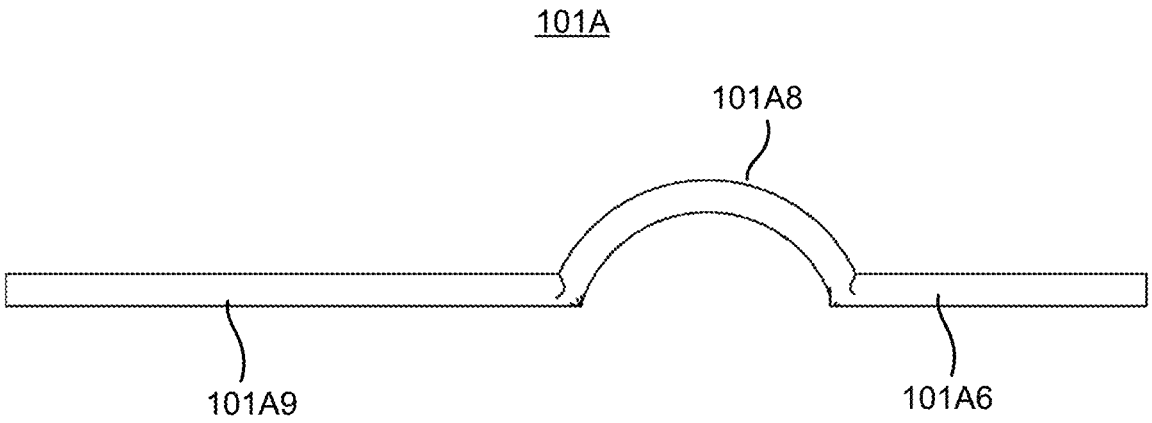
FIG. 6A-FIG. 6B illustrate a side view and perspective view of the elongated shaft having a curved forearm rest support formed between two sections of the elongated shaft, according to an embodiment.
Figure 6B:
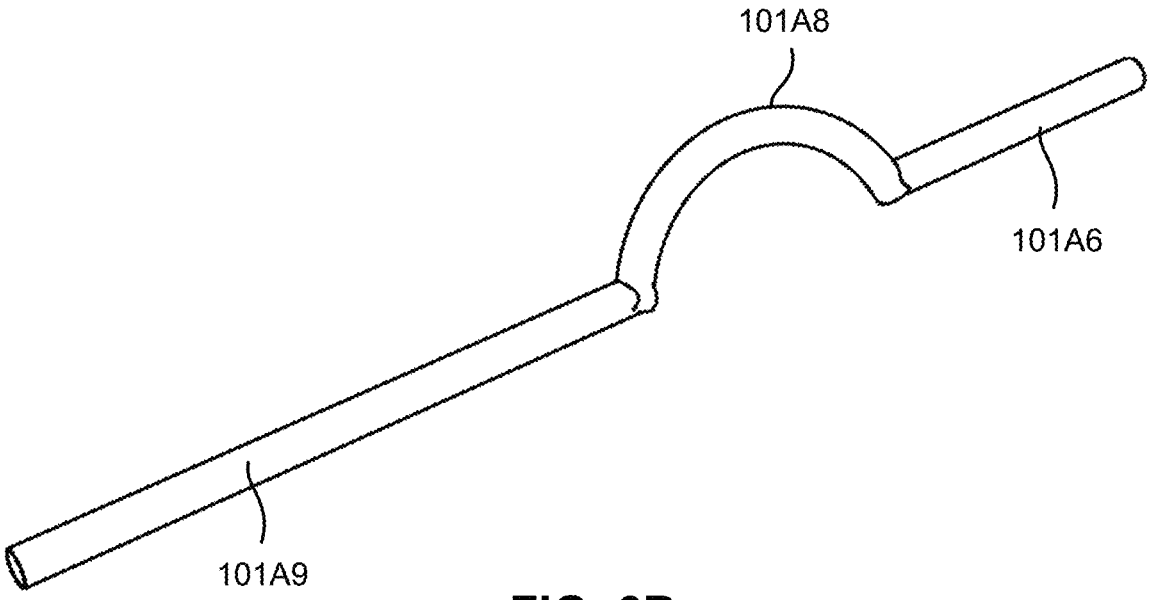

FIG. 6A-FIG. 6B illustrate a side view and perspective view of the elongated shaft 101A having a curved forearm rest support 101A8 formed between two sections (101A6, 101A9) of the elongated shaft 101A, according to an embodiment. For example, the two linear may include the fixed coupling member 101A6 and a reference guide member 101A9 separated by the curved forearm rest support 101A8. In practice, the curved forearm rest support 101A8 may be configured to rest against the forearm of the leading arm of the golfer and may provide additional spacing for accommodating the forearm of the golfer 100 at backswing, mid-swing or takeaway. In addition, the curved forearm rest support 101A8 may also provide tactile feedback to the golfer for teaching the appropriate arm positioning at the various golf swing positions.

Figure 7A:
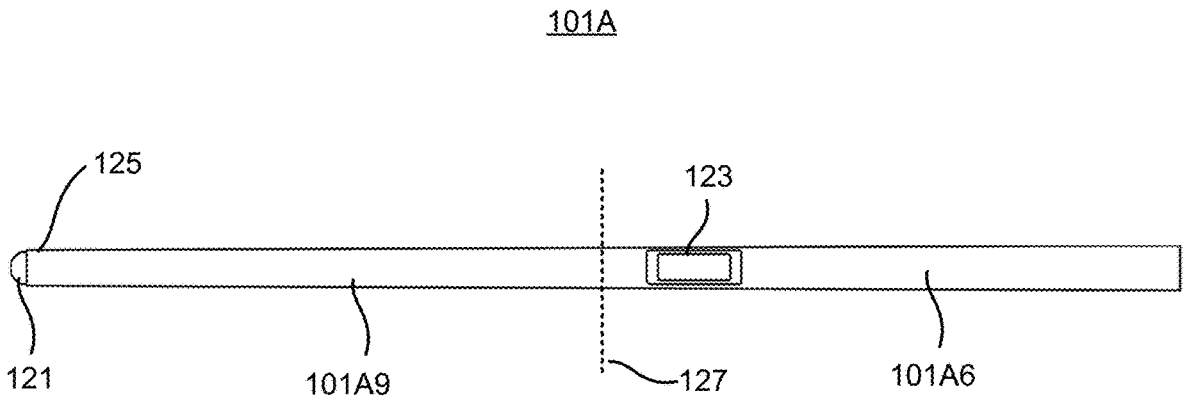
FIG. 7A-FIG. 7B illustrate a side view and perspective view of the elongated shaft having an illumination component and a lead forearm contact switch, according to an embodiment.
Figure 7B:
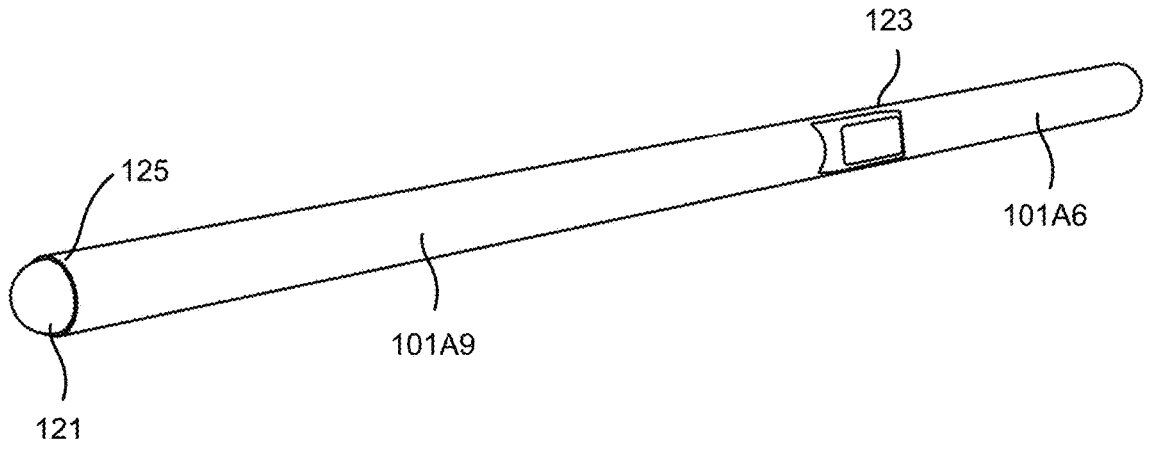

FIG. 7A-FIG. 7B illustrate a side view and perspective view of the elongated shaft 101A having an illumination component 121 and a lead forearm contact switch 123 formed on the elongated shaft 101A, according to an embodiment. In one implementation, the illumination component 121 may be applied and secured to a tip end 125 of the elongated shaft 101A while the lead forearm contact switch 123 is applied near a mid-point 127 of the elongated shaft 101A. Also included but not shown are wiring, power connectors and a battery source that power the illumination component 121. Examples of the illumination component 121 include an LED light, incandescent light, and a low-power laser light source. The lead forearm contact switch 123 may include a toggle switch, a push button switch or a SPST momentary switch for enabling or disabling the illumination component 121. In operation, the illumination component 121 in combination with the lead forearm contact switch 123 may provide the golfer 100 a simple visual feedback indicator and a tactile feedback mechanism to communicate to the golfer 100 when the leading arm of the golfer is in the proper position (i.e., when the forearm of the leading arm is resting against the lead forearm contact switch 123) while executing various golf swing positions. In this case, the visual feedback indicator may include the enabling/disabling of the LED light while the tactile feedback may be communicated to the golfer 100 when the forearm touches and rests against the lead forearm contact switch 123.

Figure 8A:
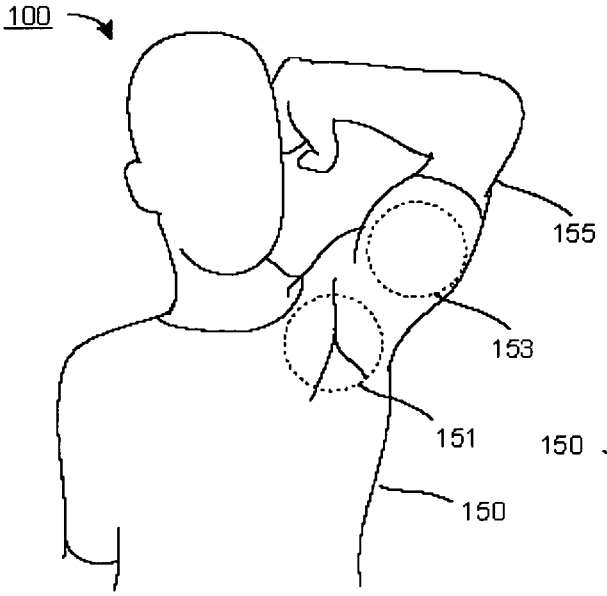
FIG. 8A-FIG. 8C illustrates the upper torso and arms of the golfer and different pressure points thereof.
Figure 8B:
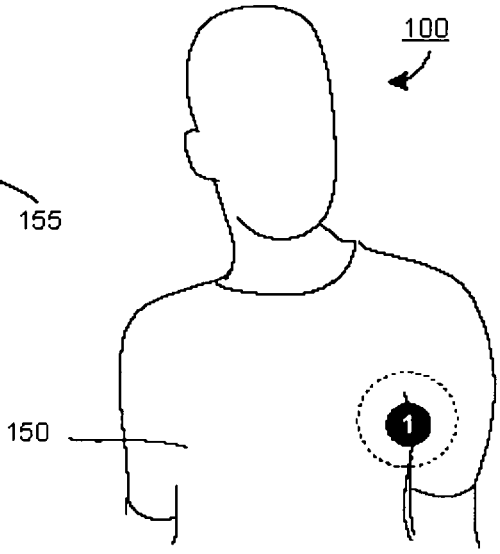
Figure 8C:
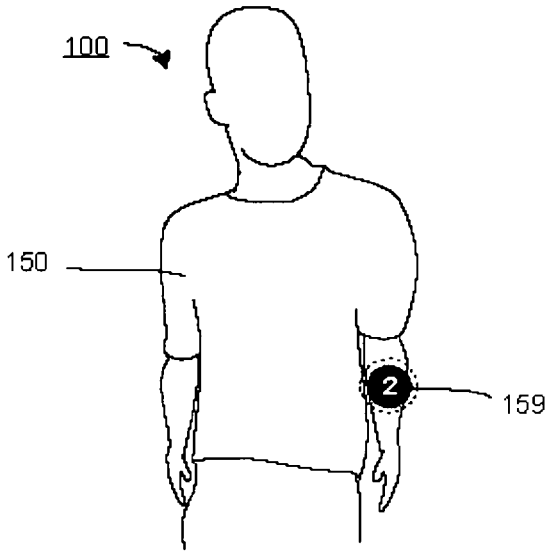

FIG. 8A-FIG. 8C illustrates the upper torso 150 the golfer 100 and pressure points (1, 2) thereof. In the forthcoming embodiments, references will be made to various body parts of the trailing arm of the golfer 100 including an axilla 151 (or armpit) and an inner bicep 153 as shown in FIG. 8A and forearm 159 as shown in FIG. 8C. An axilla pressure point 1 may be defined as an applied force between the axilla 151 and an inner bicep 153 when the arm 155 of the golfer 100 is rested against the torso 150, whereby the axilla pressure point 1 may provide a way to hold and secure the axilla support member 101B when applied. A forearm pressure point 2 may be defined as a force applied by a portion of the elongated shaft 101A on the forearm of the golfer 100.

Figure 9A:
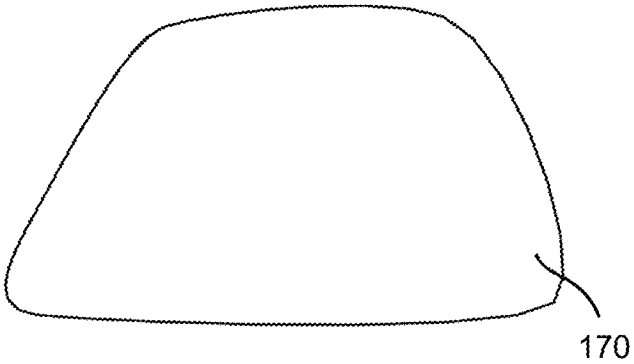
FIG. 9A-FIG. 9D illustrate a front view, top view, left side view and perspective view, respectively, of the axilla support member, according to an embodiment.
Figure 9B:
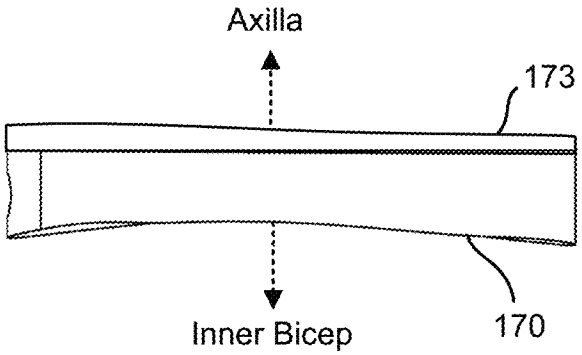
Figure 9C:
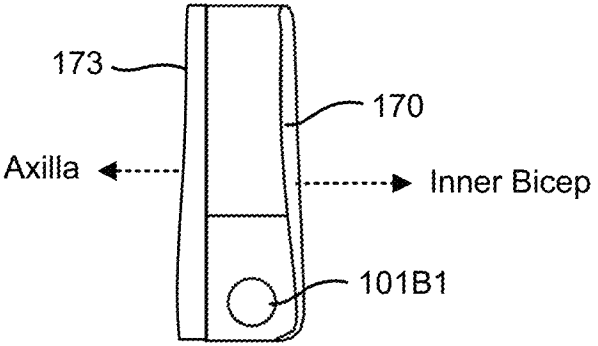
Figure 9D:
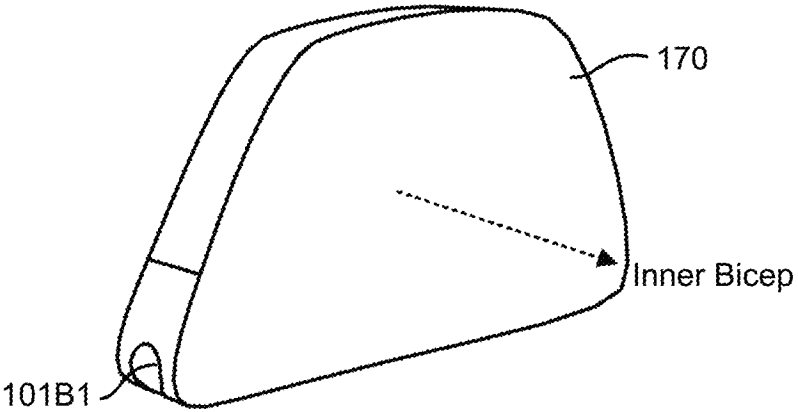
Figure 10A:
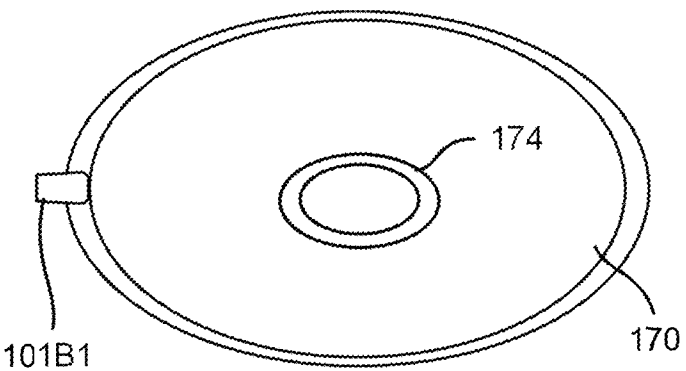
FIG. 10A-FIG. 10D illustrate a front view, top view, left side view and perspective view, respectively, of the axilla support member having an oval shaped body and curved surface, according to an embodiment.
Figure 10B:
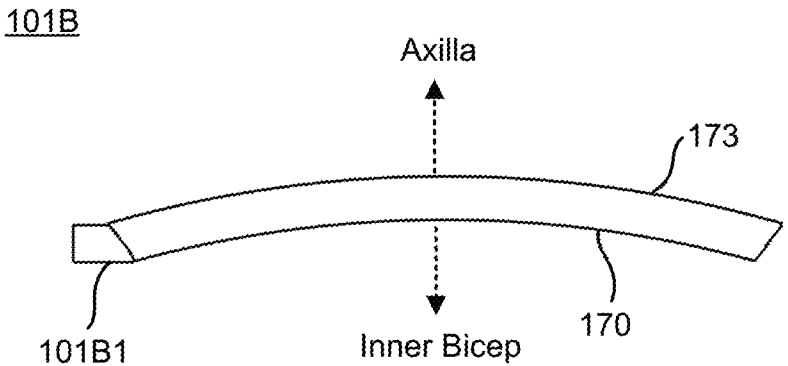
Figure 10C:
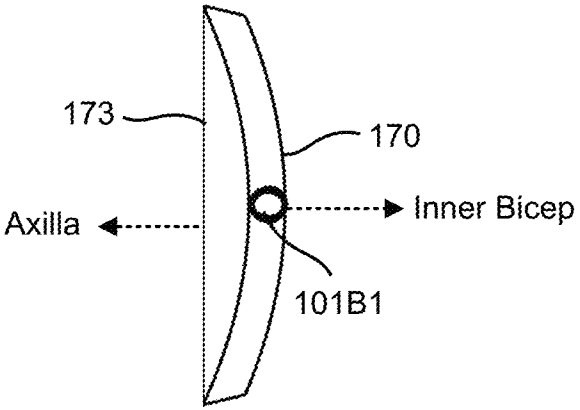
Figure 10D:
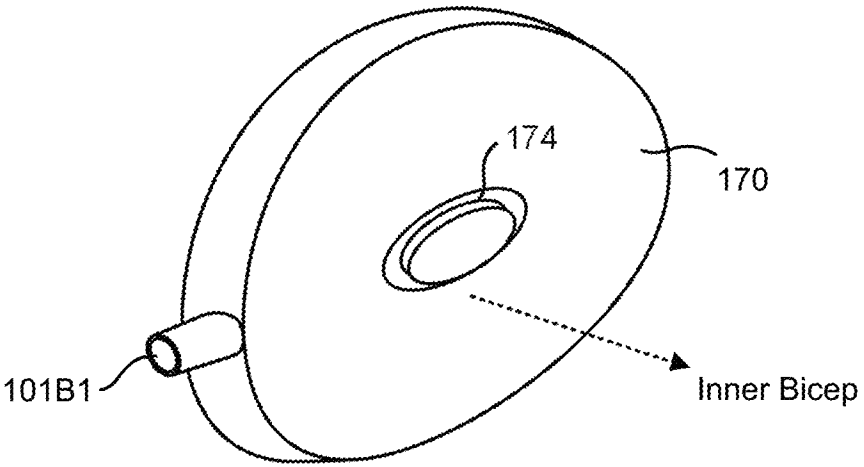

FIG. 9A-FIG. 9D illustrate a front view, top view, left side view and perspective view, respectively, of the axilla support member 101B, according to an embodiment. For example, in FIG. 9A, the axilla support member 101B is generally a flat object having a rounded regular polygon shape which, in practice, is configured to complement and fit into the axilla 151 area of the trailing arm of the golfer 100. From the top view, the axilla support member 101B shows two sides including an inner bicep side 170 and an axilla side 173. Each side may be slightly curved to accommodate and complement the natural shape of the axilla 151 and inner bicep 153 areas, providing comfort to the golfer when applied. For example, the surface and shape of the bicep side 170 of the axilla support member 101B may be complementary in shape to that of the inner bicep of the golfer 100 while the axilla side 173 of the axilla support member 101B may be complementary in shape to that of the axilla of the golfer 100 in order to provide an ergonomic, natural and snug fit when applied and held at the axilla pressure point 1 by the golfer 100, allowing the golfer 100 to fully secure, support and apply sufficient tension to the golf swing training aid rod 101 while executing the golf stroke without causing muscle tightness or discomfort to the golfer 100. Also shown in FIG. 9B and FIG. 9D is the attachment receiving member 101B1 which is, in this example, a round threaded slot formed within the axilla support member 101B. In other implementations, the attachment receiving port 101B1 may include other types of fasteners including a threaded bolt, an interlocking screw, or a quick-release component.

FIG. 10A-FIG. 10D illustrate a front view, top view, left side view and perspective view, respectively, of the axilla support member 101B having an oval shaped body and curved surface, according to another embodiment. As in the previous embodiment, the oval shaped body and curved surface of the axilla support member 101B has two sides including the inner bicep side 170 and the axilla side 173. In this example, the inner bicep side 170 has an inward curved surface (concave surface) while the axilla side 173 has an outward curved surface (convex surface) to accommodate and complement the natural shape of the axilla 151 and inner bicep 153 areas, providing comfort to the golfer when in use. In another implementation, an axilla contact switch 174 may be coupled to the inner bicep side 170 or the axilla side 173 of the axilla support member 101B. In addition, the axilla contact switch 174 may be coupled to the illumination component 121 formed on the elongated shaft 101A and battery source via electrical wires (not shown). In operation, a visual feedback may be communicated to the golfer 100 via the illuminated component 121 (e.g., light is activated) when the axilla contact switch 174 is properly applied and triggered by the golfer 100.

Figure 11:
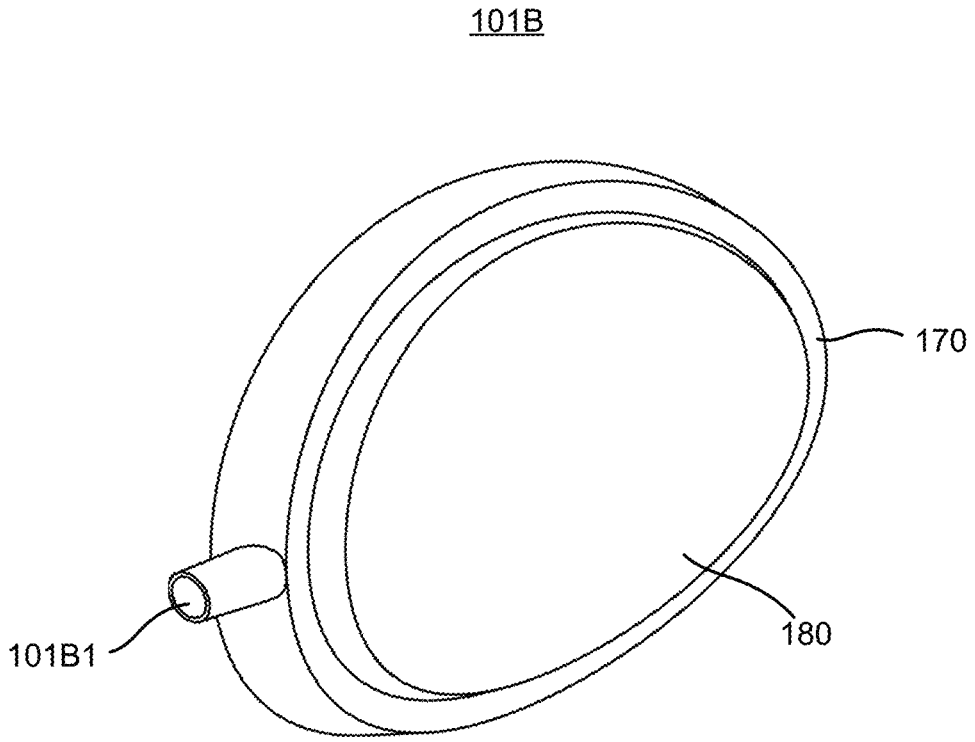
FIG. 11 illustrates a perspective view of the axilla support member having a foam pad applied to the inner bicep side of the axilla support member, according to an embodiment.

FIG. 11 illustrates a perspective view of the axilla support member 101B having a foam pad 180 applied to the inner bicep side 170 of the axilla support member 101B, according to an embodiment. The foam pad 180 is similar in shape to the axilla support member 101B of the trailing arm and fastened to the inner bicep side 170 using glue, adhesive tape, or a hook-and-loop fastener. In practice, the foam pad 180 may provide the golfer 100 a layer of cushion for protecting and minimizing discomfort of the inner bicep of the golfer 100 over the course of multiple golf swings.

Figure 12:
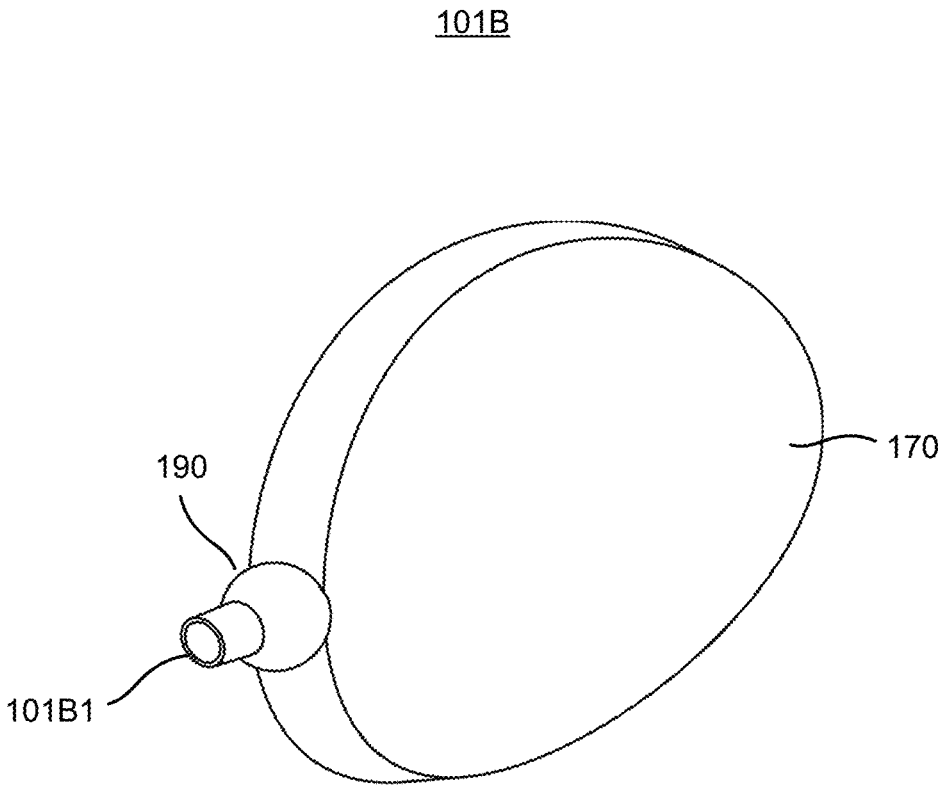
FIG. 12 illustrates a perspective view of the axilla support member having a rotating ball joint connecting the attachment receiving member to the axilla support member, according to an embodiment.
Figure 13A:
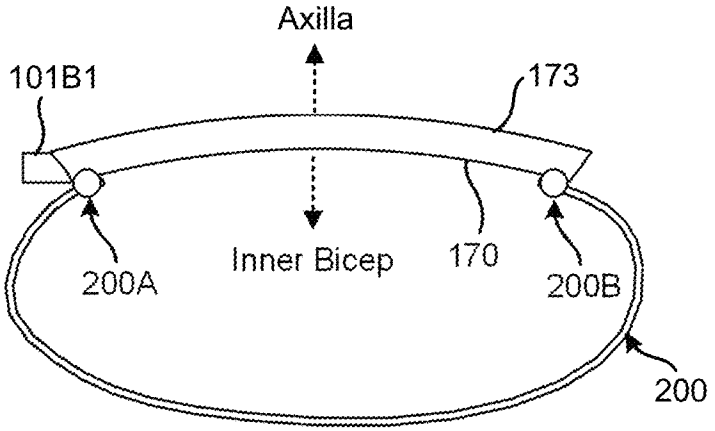
FIG. 13A-FIG. 13D illustrate a top view, back view, side view and perspective view, respectively, of the axilla support member with an arm band attachment, according to an embodiment.
Figure 13B:
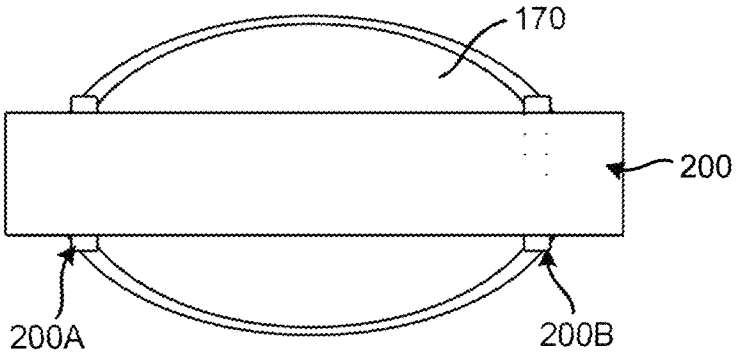
Figure 13C:
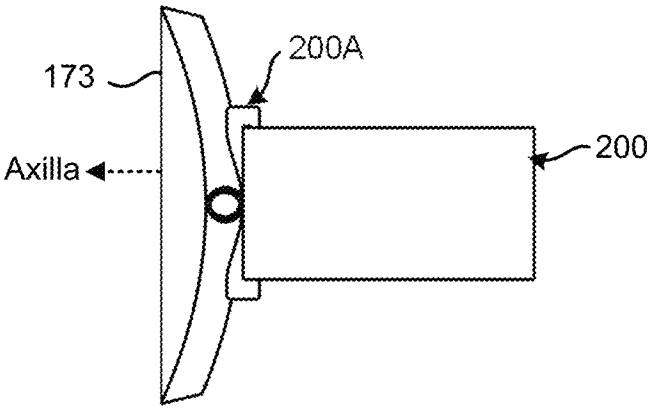
Figure 13D:
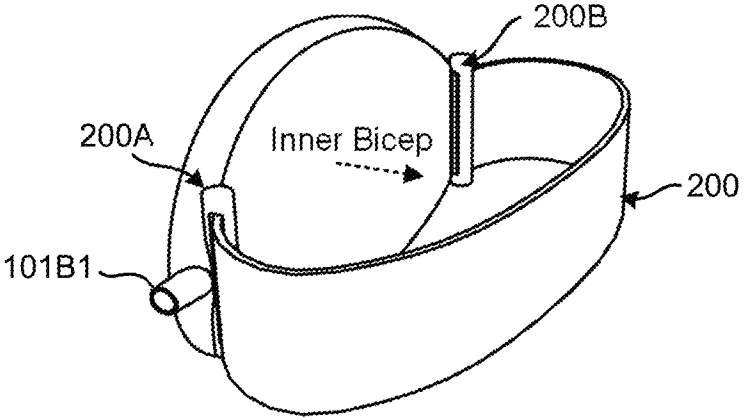
Figure 14B:
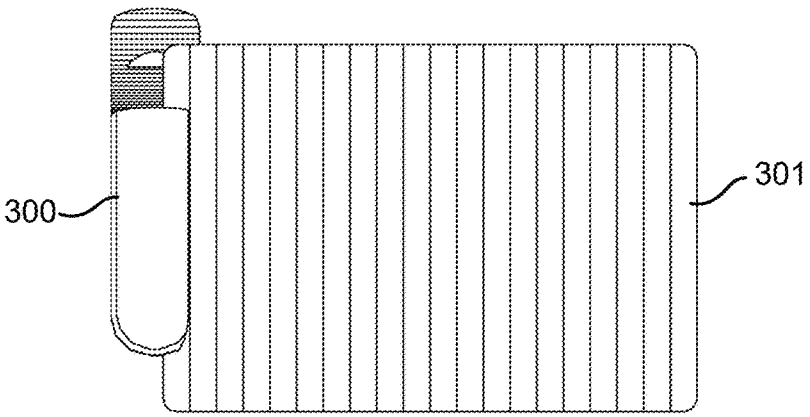
FIG. 14A-FIG. 14D illustrate a top view, back view, side view and perspective view, respectively, of a j-hook type axilla support member, according to an embodiment.
Figure 14D:
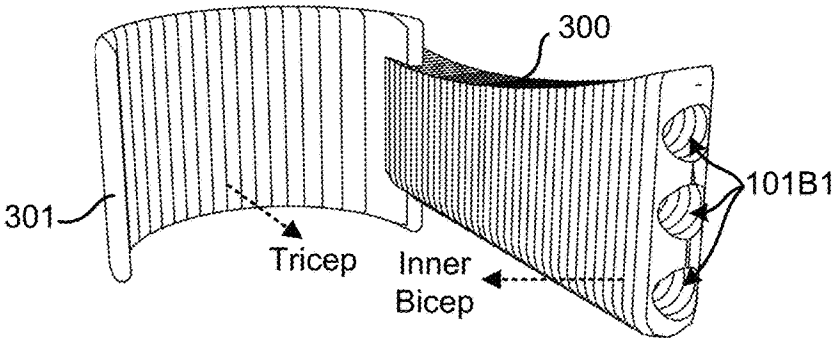
Figure 14A:
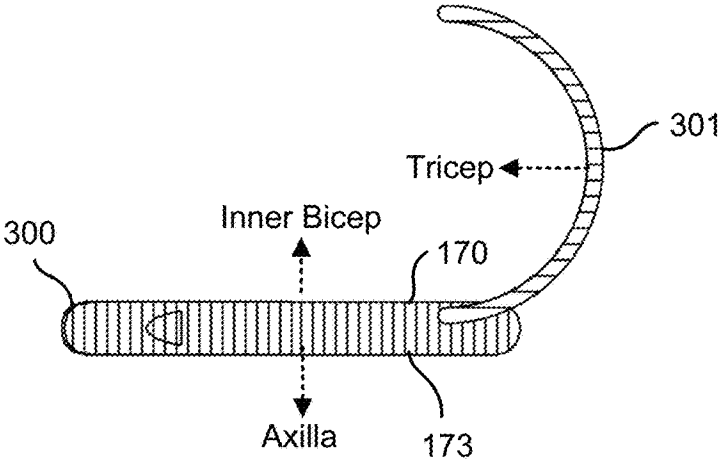
Figure 14C:
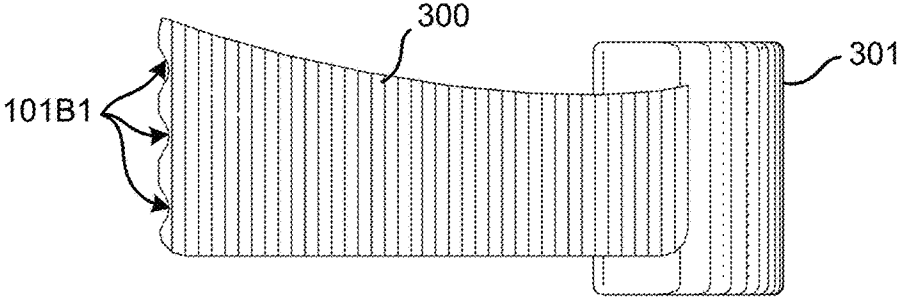
Figure 15B:
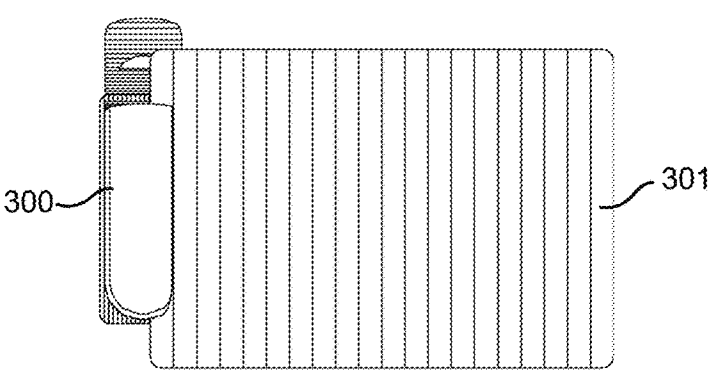
FIG. 15A-FIG. 15D illustrate a top view, back view, side view and perspective view, respectively, of the j-hook type axilla support member with extendable members, according to an embodiment.
Figure 15D:
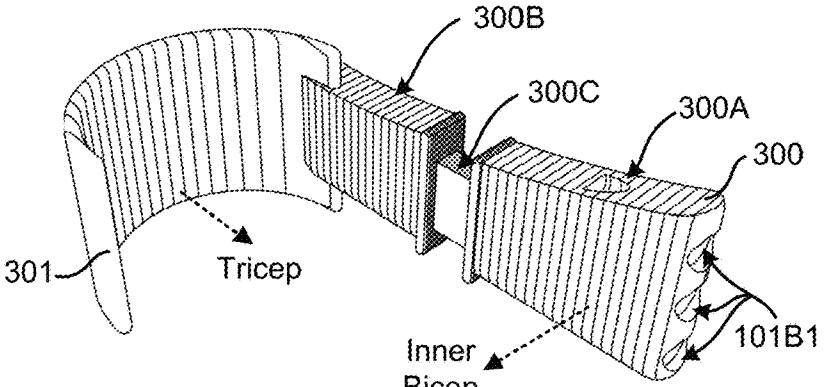
Figure 15A:
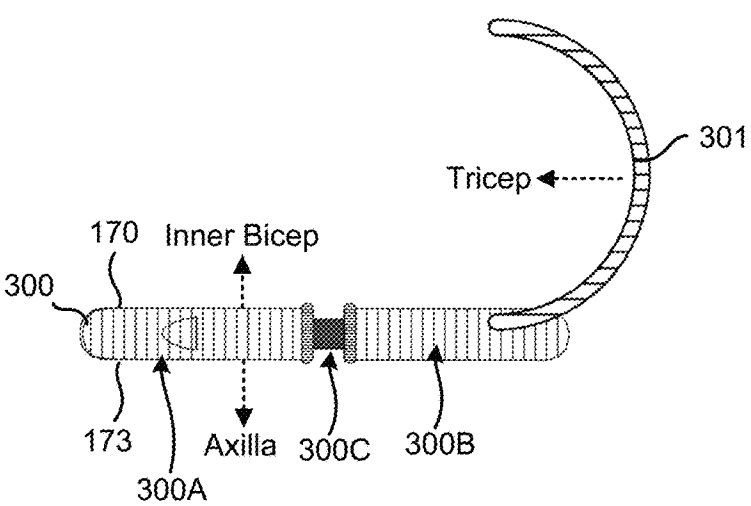
Figure 15C:
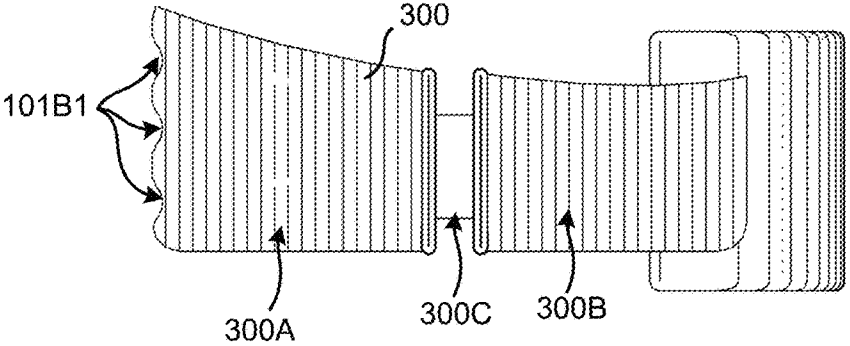

FIG. 12 illustrates a perspective view of the axilla support member 101B having a rotating ball joint 190 connecting the attachment receiving member 101B1 to the axilla support member 101B, according to an embodiment. Functionally, the rotating ball joint 190 provides a rotating mechanism that allows for fine tuning and adjustments to the elongated shaft 101A, thereby visually modifying the reference guide positioning during the golf swing when attached.

FIG. 13A-FIG. 13D illustrate a top view, back view, side view and perspective view, respectively, of the axilla support member 101B with an arm band attachment 200, according to an embodiment. The axilla support member 101B may include two arm band slots (200A, 200B) formed at each end of the axilla support member 101B into which a portion of each end of the arm band attachment 200 is inserted and secured thereon. In one aspect, the arm band attachment 200 is an elastic material made from flexible and breathable fabrics. In another aspect, the arm band attachment 200 may be adjustable to fit a variety of arm sizes.

In yet another aspect, the arm band attachment 200 may be separated into two strap parts and joined by a buckle, clip, or clasp. In practice, the arm band attachment 200 is securely worn on the bicep of the trailing arm of the golfer 100 preventing the golf swing training aid rod 101 from falling off of the trailing arm of the golfer 100.

FIG. 14A-FIG. 14D illustrate a top view, back view, side view and perspective view, respectively, of a j-hook type axilla support member 101B, according to an embodiment. In this embodiment, the j-hook type axilla support member 101B may include an axilla block 300 coupled to a triceps rest attachment 301. The axilla block 300 may be a flat and planar object having a curved top portion that is designed to lie against the axilla of the trailing arm of the golfer 100 when worn by the golfer 100. The axilla block 300 may include multiple attachment receiving members 101B1 for allowing various positions into which the elongated shaft 101A may be inserted. Having multiple attachment receiving members 101B1 may provide the golfer 100 the ability to adjust the position of the elongated shaft 101A allowing the golfer 100 to fine tune the visual reference guide to an appropriate line of sight. To stabilize the axilla support member 101B and prevent it from shifting during the golf stroke, the triceps rest attachment 301 includes a C-shaped body that generally conforms and supported against triceps of the arm of the golfer 100. A foam pad (not shown) may be applied on an inner side of the triceps rest attachment 301 so that it may provide additional comfort to the golfer 100 when worn and used while executing the golf stroke.

FIG. 15A-FIG. 15D illustrate a top view, back view, side view and perspective view, respectively, of the j-hook type axilla support member 101B with extendable members, according to an embodiment. In this embodiment, the j-hook type axilla support member 101B the axilla block 300 may include a sliding axilla block 300A coupled to a fixed axilla block 300B via a connector bar 300C. In operation, the sized of the axilla block 300 may be lengthened by pulling the sliding axilla block 300A away from the fixed axilla block 300B and shortened by pushing the sliding axilla block 300A towards from the fixed axilla block 300B. In other implementations, the connector bar 300C may be any type of slidable connectors using brackets, pistons, rods, and sliding tracks. In practice, extending and retracting the sliding axilla block 300A allows the golfer 100 to adjust the length of the axilla block 300 so that it may comfortable fit and be worn by different golfers having various arm and body sizes.

Figure 16:
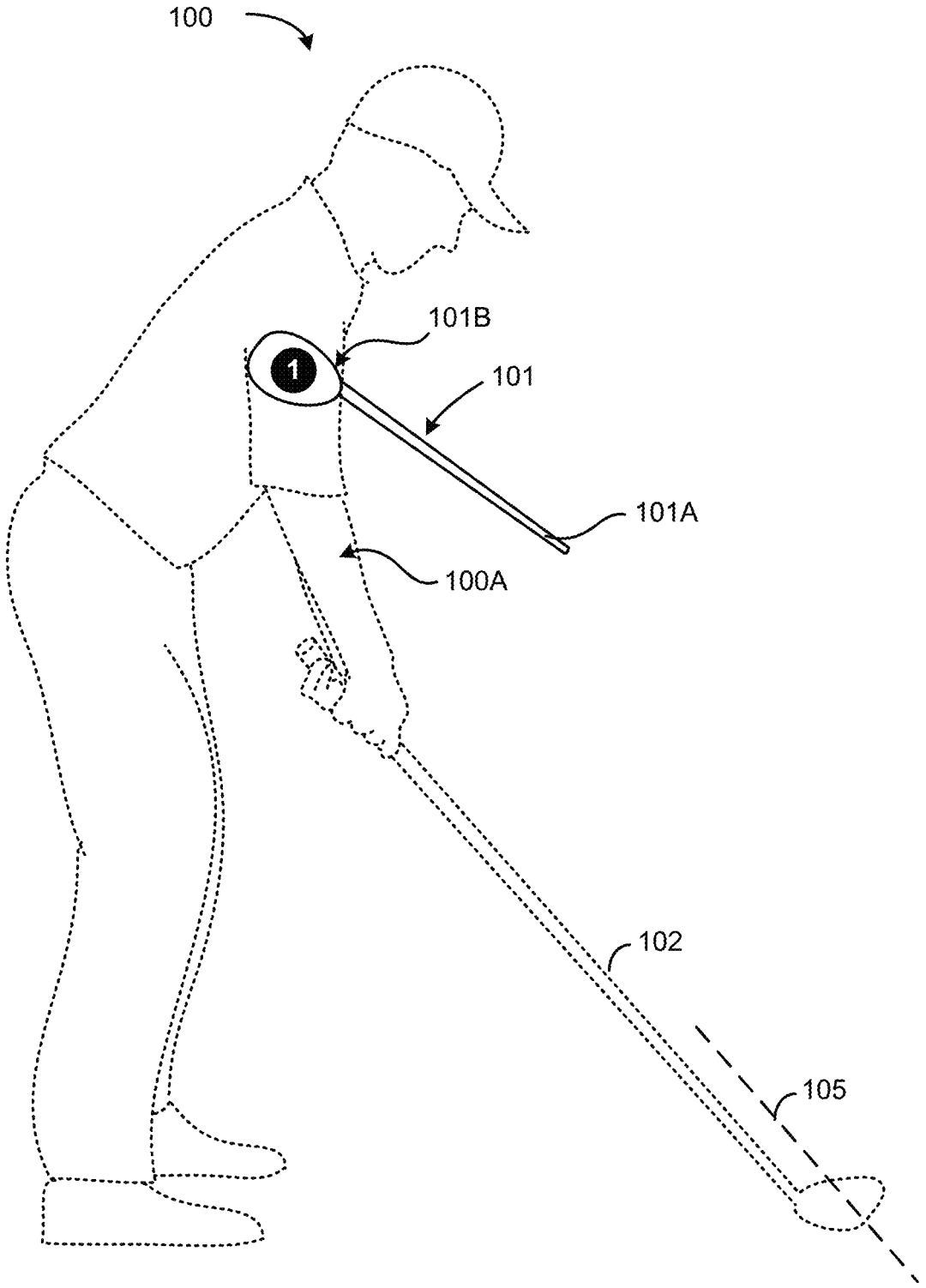
FIG. 16 illustrates a first golf swing position of the golfer using the golf swing training aid rod, according to an embodiment.

FIG. 16 illustrates a first golf swing position (P1—Address) of the golfer 100 using the golf swing training aid rod 101, according to an embodiment. At the Address position (P1), the axilla support member 101B of the golf swing training aid rod 101 is firmly held and secured by the trailing arm 100A between the inner bicep and axilla of the golfer 100 at the first pressure point 1 while the reference tip 101A1 of the elongated shaft 101A is pointed at ground towards the imaginary target line 105.

Figure 17:
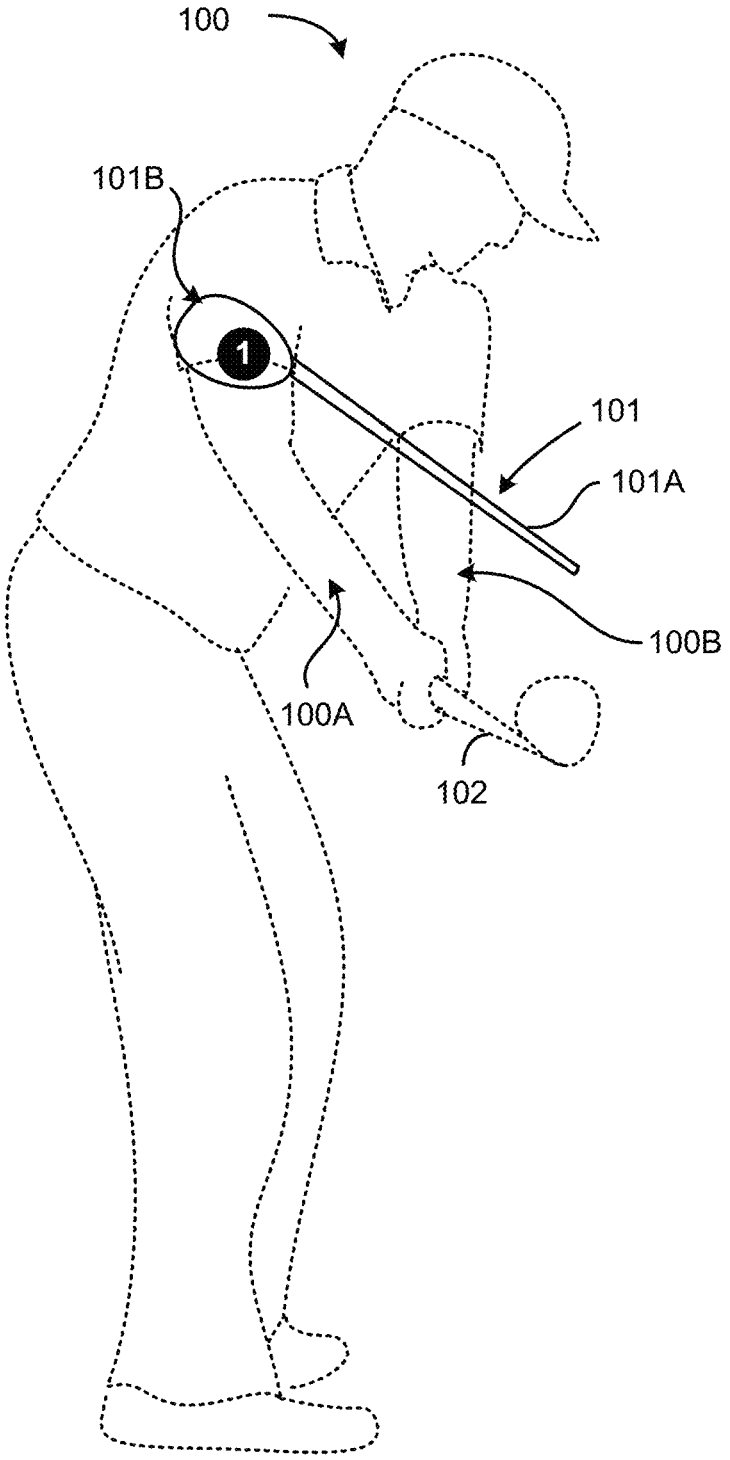
FIG. 17 illustrates a second golf swing position of the golfer using the golf swing training aid rod, according to an embodiment.

FIG. 17 illustrates a second golf swing position (P2—Club-Shaft Parallel with Ground on Takeaway) of the golfer 100 using the golf swing training aid rod 101, according to an embodiment. At the P2 position, the axilla support member 101B of the golf swing training aid rod 101 remains secured by the trailing arm 100A between the inner bicep and axilla of the golfer 100 at the first pressure point 1 while the leading arm 101B is brought near, but not in yet in contact with, a portion the elongated shaft 101A.

Figure 18:
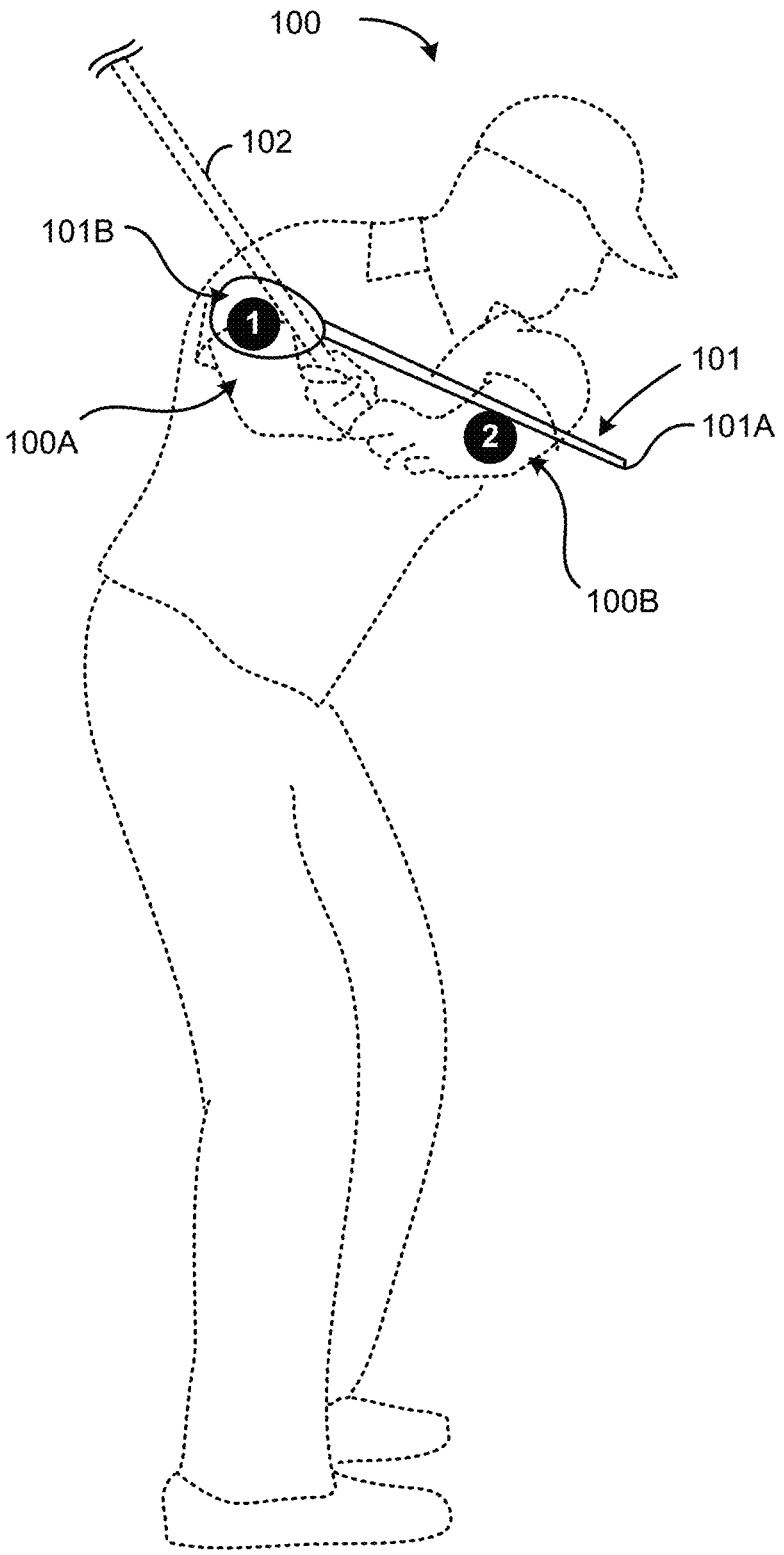
FIG. 18 illustrates a third golf swing position of the golfer using the golf swing training aid rod, according to an embodiment.

FIG. 18 illustrates a third golf swing position (P3—Lead Arm Parallel with Ground) of the golfer 100 using the golf swing training aid rod 101, according to an embodiment. At the P3 position, the axilla support member 101B of the golf swing training aid rod 101 still remains secured by the trailing arm 100A at the first pressure point 1 while the leading arm 100B makes a gentle contact with the elongated shaft 101A at the second pressure point 2. At this position, both arms (trailing arm 100A and leading arm 100B) are connected by the elongated shaft 101A at the pressure points (1, 2).

Figure 19:
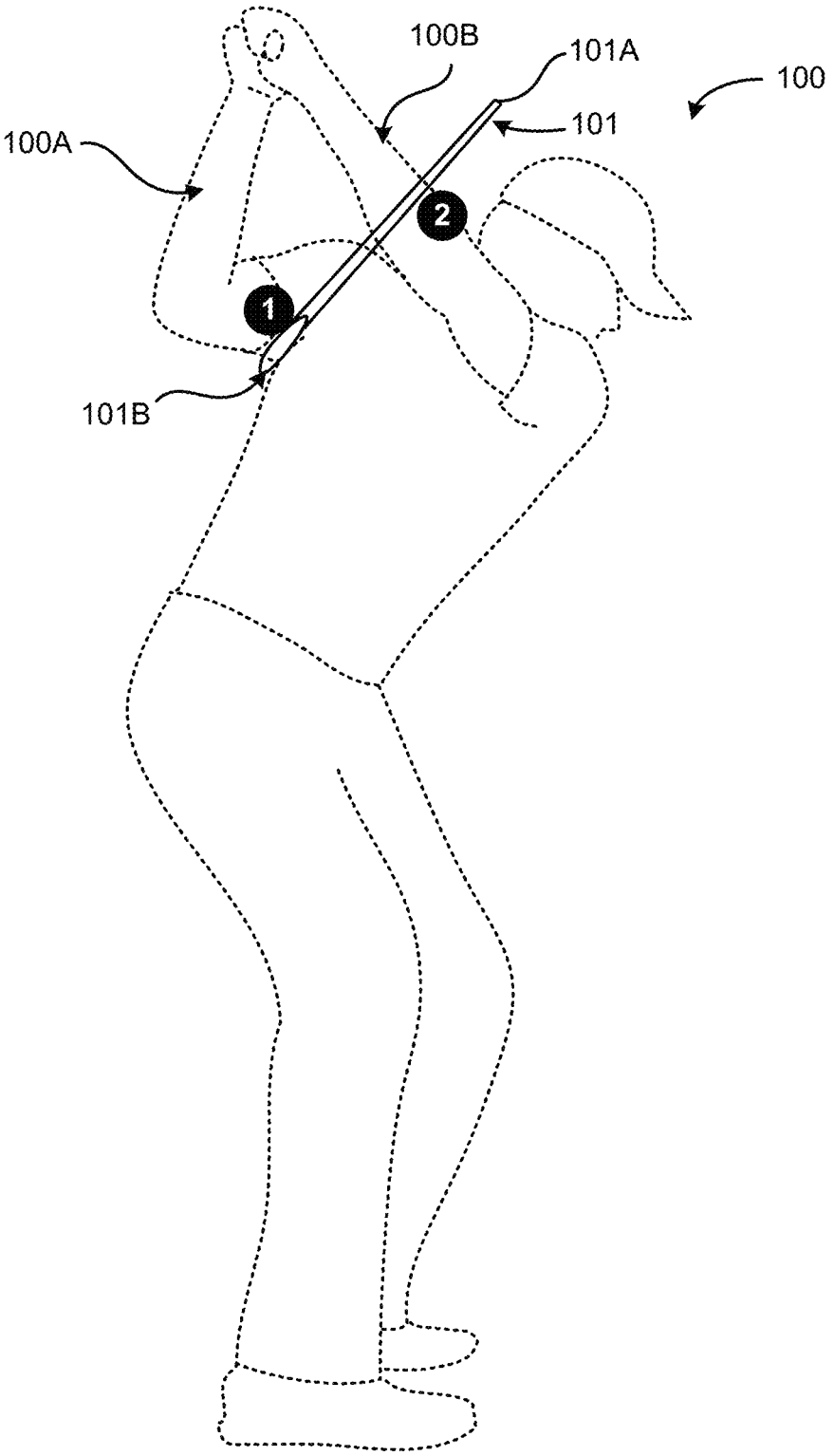
FIG. 19 illustrates a fourth golf swing position of the golfer using the golf swing training aid rod, according to an embodiment.

FIG. 19 illustrates a fourth golf swing position (P4—Top of Backswing) of the golfer 100 using the golf swing training aid rod 101, according to an embodiment. At the P4 position, both arms (trailing arm 100A and leading arm 100B) remain connected by the elongated shaft 101A at the pressure points (1, 2). For proper follow through, the golf swing training aid rod 101 may provide a visual and tactile feedback that teaches the golfer to keep both the trailing arm 100A and leading arm 100B) connected to the elongated shaft 101A without dropping the arms below or off the golf swing training aid rod 101.

Figure 20:
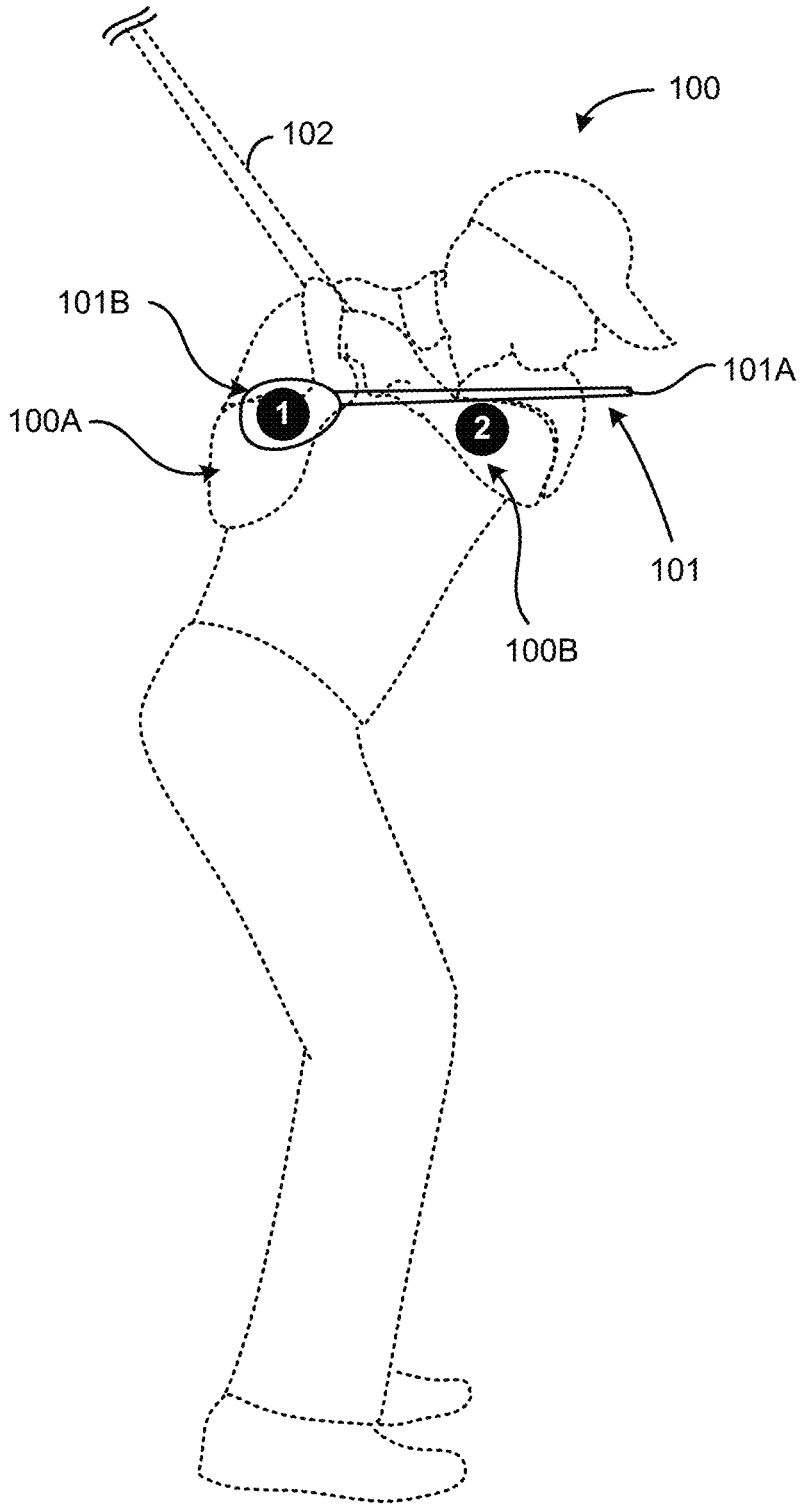
FIG. 20 illustrates a fifth golf swing position of the golfer using the golf swing training aid rod, according to an embodiment.

FIG. 20 illustrates a fifth golf swing position (P5—Lead Arm Parallel with Ground on Downswing) of the golfer 100 using the golf swing training aid rod 101, according to an embodiment. At the P5 position, both arms (trailing arm 100A and leading arm 100B) still remain connected by the elongated shaft 101A at the pressure points (1, 2) with the elongated shaft 101A near parallel to the ground.

Figure 21:
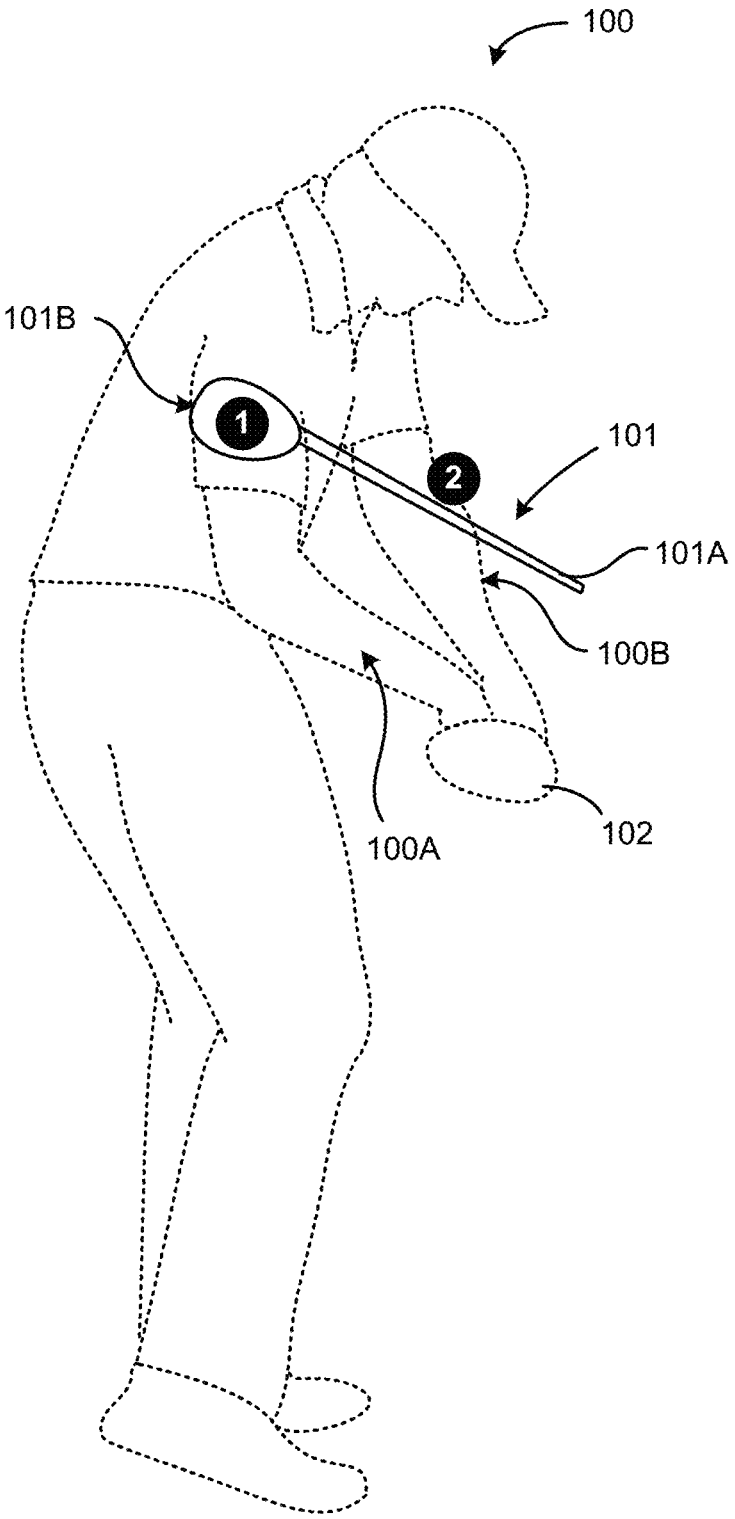
FIG. 21 illustrates a sixth golf swing position of the golfer using the golf swing training aid rod, according to an embodiment.

FIG. 21 illustrates a sixth golf swing position (P6—Club-Shaft Parallel with Ground on Downswing) of the golfer 100 using the golf swing training aid rod 101, according to an embodiment. At the P6 position, both arms (trailing arm 100A and leading arm 100B) still remain connected by the elongated shaft 101A at the pressure points (1, 2) with the reference tip 101A1 of the elongated shaft 101A is pointed at ground.

Figure 22:
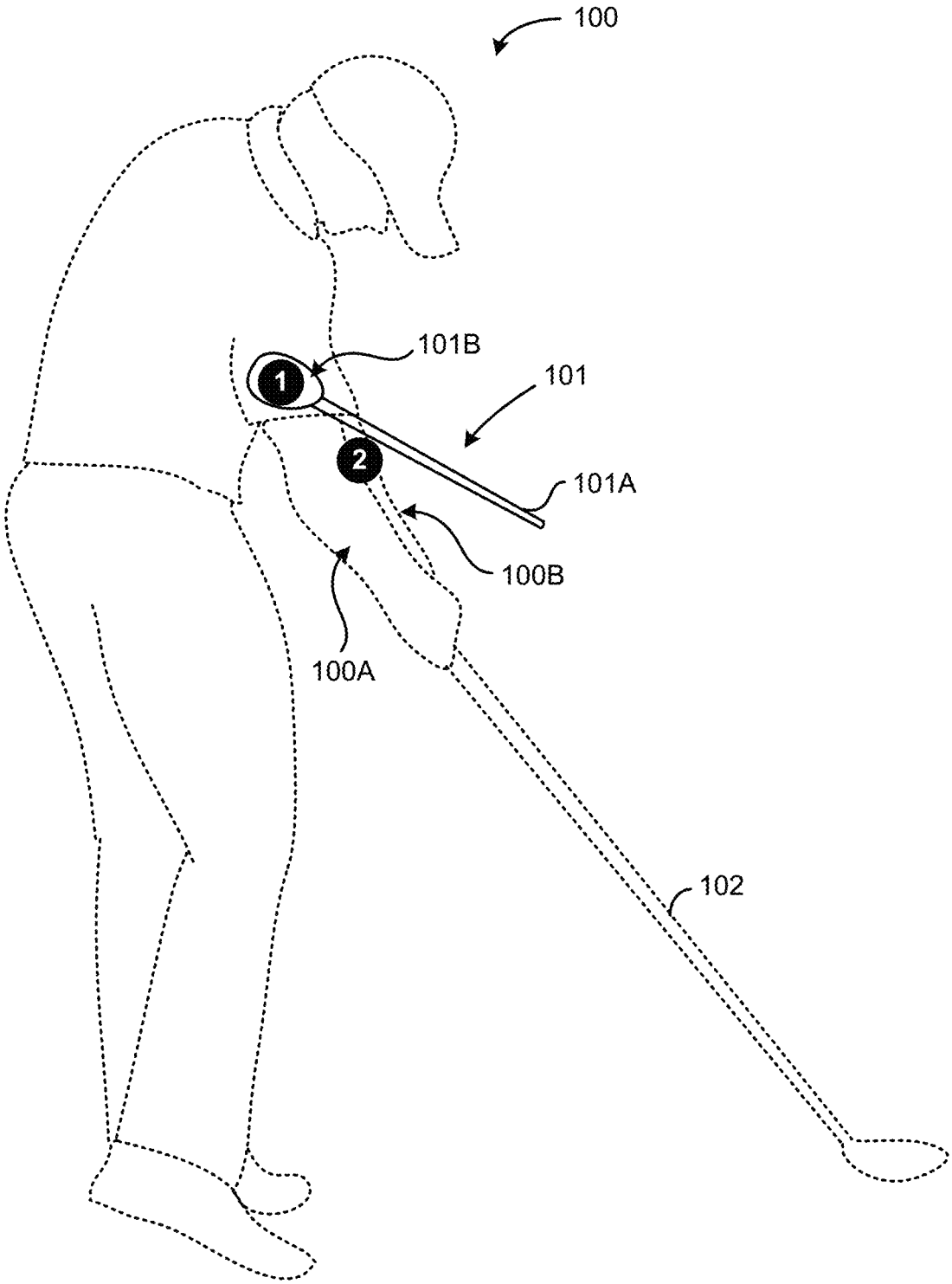
FIG. 22 illustrates a seventh golf swing position of the golfer using the golf swing training aid rod, according to an embodiment.

FIG. 22 illustrates a seventh golf swing position (P7—Impact) of the golfer 100 of the golfer 100 using the golf swing training aid rod 101, according to an embodiment. At the P7 position, both arms (trailing arm 100A and leading arm 100B) still remain connected by the elongated shaft 101A at the pressure points (1, 2) with the reference tip 101A1 of the elongated shaft 101A pointing forward in the direction of the target.

Figure 23:
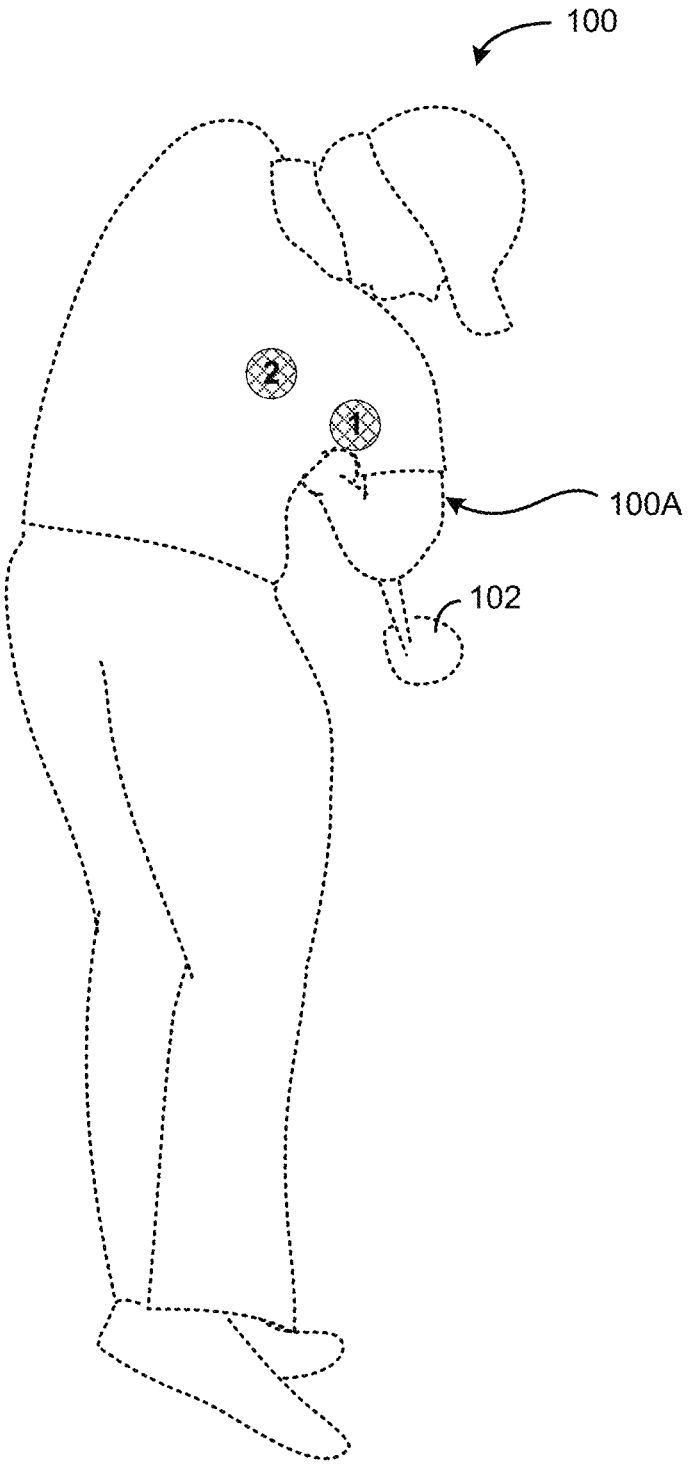
FIG. 23 illustrates an eighth golf swing position of the golfer using the golf swing training aid rod, according to an embodiment.

FIG. 23 illustrates an eighth golf swing position (P8—Club-Shaft Parallel with Ground on Follow-Through) of the golfer 100 using the golf swing training aid rod 101, according to an embodiment. At the P8 position, both arms (trailing arm 100A and leading arm 100B) still remain connected by the elongated shaft 101A at the pressure points (1, 2) with the reference tip 101A1 of the elongated shaft 101A slightly pointing upward.

Figure 24:
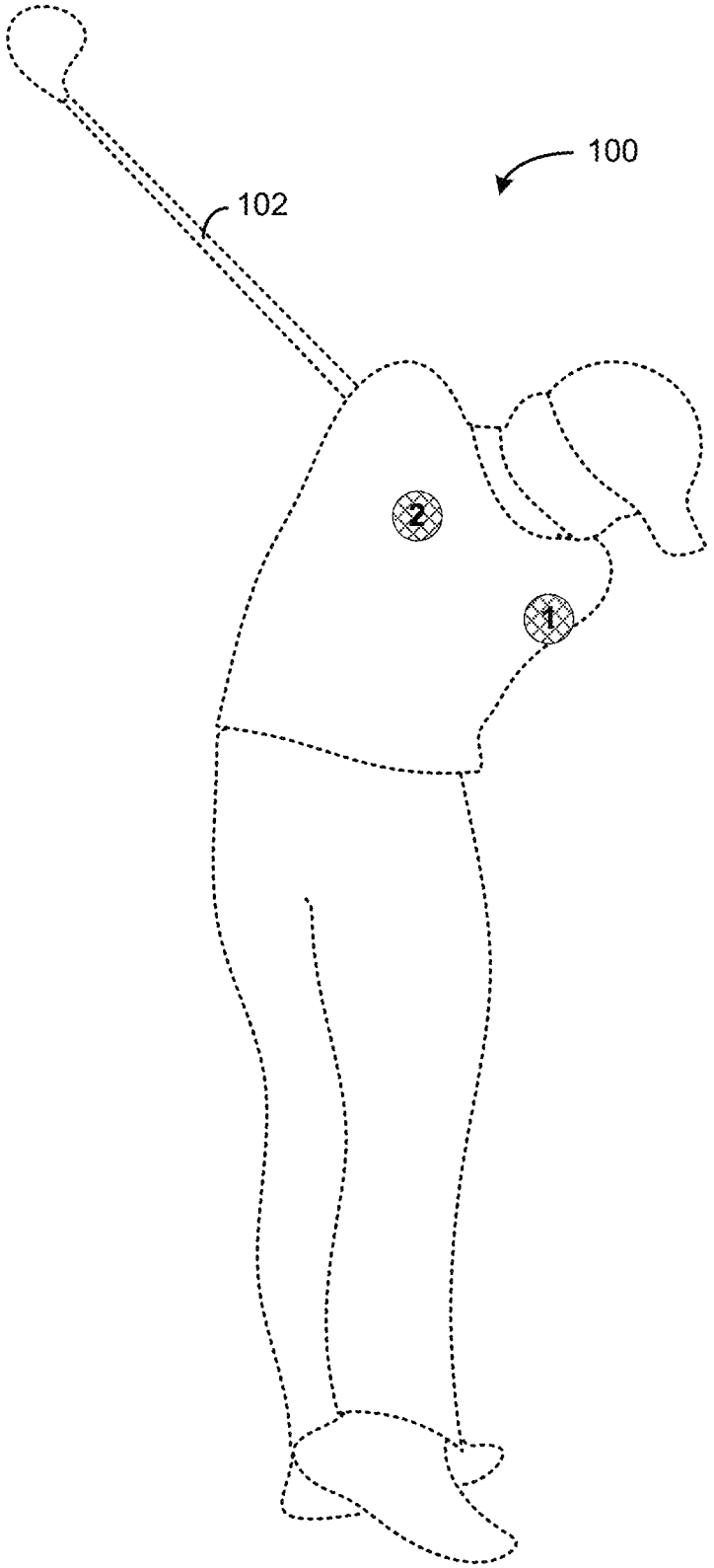
FIG. 24 illustrates a ninth golf swing position of the golfer using the golf swing training aid rod, according to an embodiment.

FIG. 24 illustrates a ninth golf swing position (P9—Trailing Arm Parallel with Ground on Follow-Through) of the golfer 100 using the golf swing training aid rod 101, according to an embodiment. At the P9 position, both arms (trailing arm 100A and leading arm 100B) still remain connected by the elongated shaft 101A at the pressure points (1, 2) with the reference tip 101A1 of the elongated shaft 101A pointing upward and towards the sky.

Figure 25:
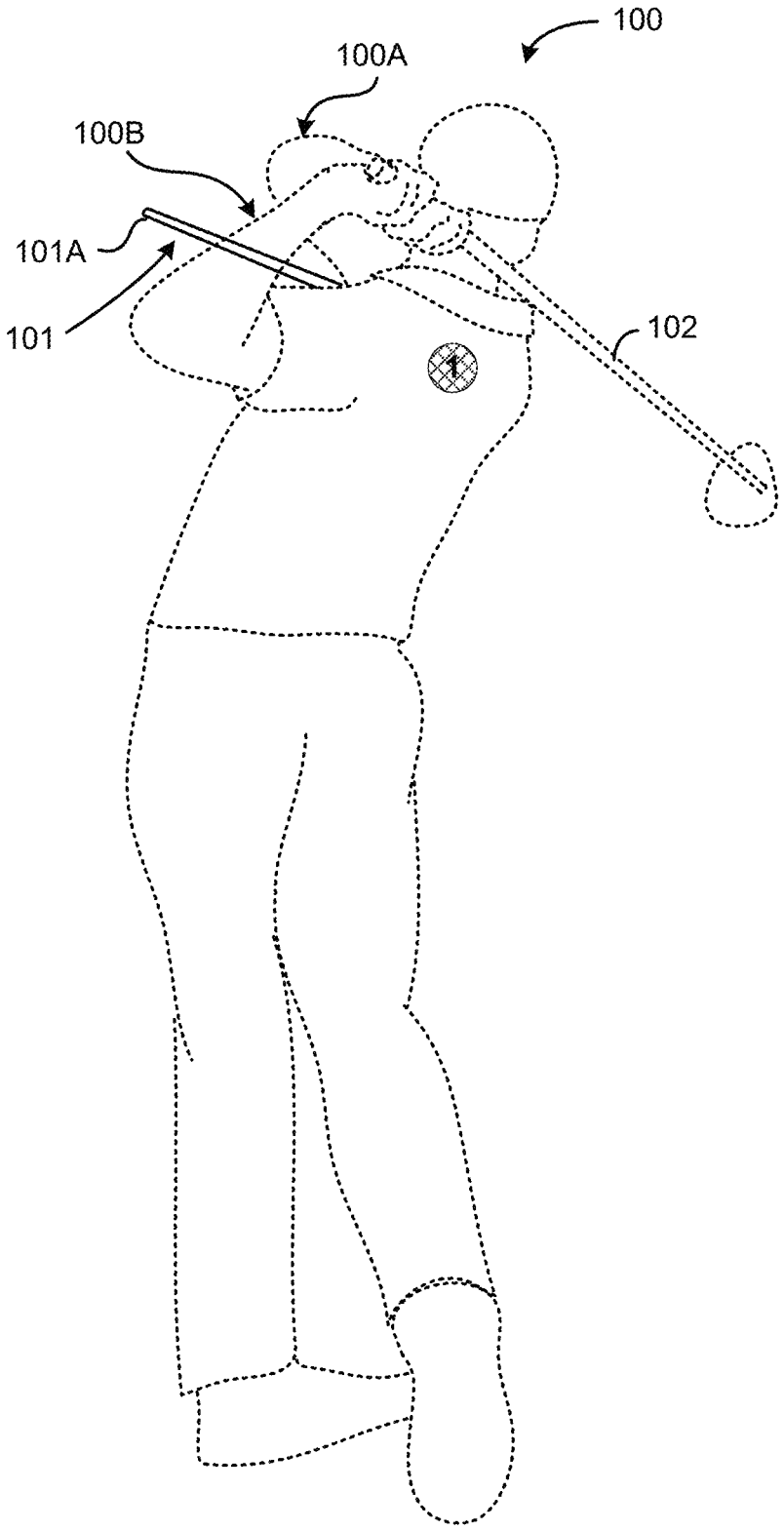
FIG. 25 illustrates a tenth golf swing position of the golfer using the golf swing training aid rod, according to an embodiment.

FIG. 25 illustrates a tenth golf swing position (P10—Finish) of the golfer 100 of the golfer 100 using the golf swing training aid rod 101, according to an embodiment. At the P10 position, the trailing arm 100A still remains connected to the axilla support member 101B of the golf swing training aid rod 101 at the pressure point 1 while the leading arm 100B may come off and no longer touch the elongated shaft 101A.

Figure 26:
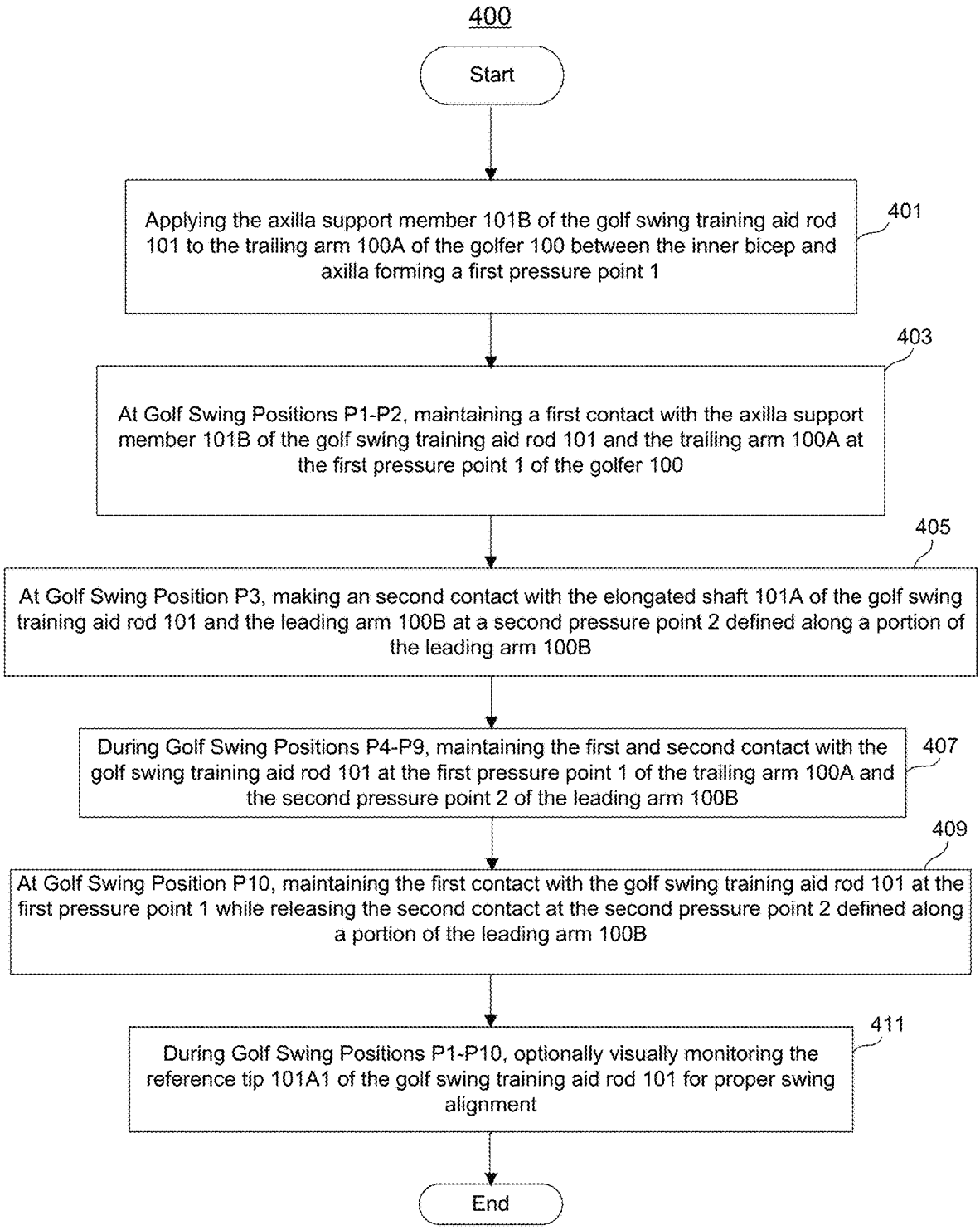
FIG. 26 illustrates a flowchart demonstrating steps of using the golf swing training aid rod for aiding and teaching the golfer the proper golf swing and positioning of the trailing arm and the leading arm of the golfer through visual and tactile feedback, according to another embodiment.

FIG. 26 illustrates a flowchart 400 demonstrating steps of using the golf swing training aid rod 101 for teaching the golfer 100 the proper golf swing and positioning of the trailing arm 100A and the leading arm 100B through visual and tactile feedback, according to another embodiment. Visually, the reference tip 101A1 of the elongated shaft 101A provides a visual reference for the golfer to "see" the direction of the swing rotation while the tactile feedback at pressure point 1 and pressure point 2 allows the golfer to "feel" the axilla support member and a portion of the elongated shaft 101A to keep the trailing arm and leading arm from dropping and maintain the proper arm positions during golf swing positions P3-P9. The steps for using the golf swing training aid rod 101 include:

1. Applying the axilla support member 101B of the golf swing training aid rod 101 to the trailing arm 100A of the golfer 100 between the inner bicep and axilla forming a first pressure point 1 (Step 401);
2. At Golf Swing Positions P1-P2, maintaining a first contact with the axilla support member 101B of the golf swing training aid rod 101 and the trailing arm 100A at the first pressure point 1 of the golfer 100 (Step 403);
3. At Golf Swing Position P3, making an second contact with the elongated shaft 101A of the golf swing training aid rod 101 and the leading arm 100B at a second pressure point 2 defined along a portion of the leading arm 100B (Step 405);
4. During Golf Swing Positions P4-P9, maintaining the first and second contact with the golf swing training aid rod 101 at the first pressure point 1 of the trailing arm 100A and the second pressure point 2 of the leading arm 100B (Step 407);
5. At Golf Swing Position P10, maintaining the first contact with the golf swing training aid rod 101 at the first pressure point 1 while releasing the second contact at the second pressure point 2 defined along a portion of the leading arm 100B (Step 409).
6. During Golf Swing Positions P1-P10, optionally visually monitoring the reference tip 101A1 of the golf swing training aid rod 101 for proper swing alignment (Step 411).

In sum, advantages of the golf swing training aid rod 101 include, for example, Provides a visual feedback via the reference tip 101A1 of the elongated shaft 101A;

Provides a tactile feedback via the axilla support member 101B and a portion of the elongated shaft 101A at pressure point 1 and pressure point 2, respectively;

Helps arms connected through golf swing positions P3-P9;

Helps keeps Torso-Arm connected through swing;

Helps keeps the golfer on the proper shift plane and shoulder plane;

Helps with tilt and rotation of the club path;

Helps golfer to keep the arms at the proper upward position during P3-P9, preventing both arms from dropping or sliding down during swing.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is:

1. A golf swing training aid rod for teaching a golfer a golf swing and positioning of a leading arm and a trailing arm of the golfer through visual and tactile feedback comprising:

an elongated shaft having a reference tip located at a first end of the elongated shaft and an attachment member located at a second end of the elongated shaft, wherein the first end is opposite to the second end; and an axilla support member having a flat body, an axilla side formed on a first side of the flat body, an inner bicep side formed on a second side of the flat body, and an attachment receiving member formed at one end of the flat body, wherein the attachment receiving member is coupled to the attachment member of the elongated shaft, wherein the axilla support member provides a first pressure point formed between an inner bicep and an axilla member of the trailing arm of the golfer, and wherein a portion of the elongated shaft provides a second pressure point on the leading arm, wherein the elongated shaft provides the golfer a visual reference guide and tactile feedback to the leading arm of the golfer.

2. The golf swing training aid rod of claim 1, wherein the elongated shaft includes telescoping members to extend or retract an overall length of the elongated shaft.

3. The golf swing training aid rod of claim 1, wherein the elongated shaft includes a rotating member coupling an upper portion of the elongated shaft to a fixed coupling member, wherein the fixed coupling member is coupled to the attachment receiving member.

4. The golf swing training aid rod of claim 3, wherein the elongated shaft includes a curved forearm rest support formed between two sections of the elongated shaft, wherein the two sections include the fixed coupling member and a reference guide member.

5. The golf swing training aid rod of claim 1, wherein the elongated shaft includes an illumination component and a contact switch formed on the elongated shaft, wherein the illumination component is applied and secured to a tip end of the elongated shaft and the contact switch is applied near a mid-point of the elongated shaft.

6. The golf swing training aid rod of claim 1, wherein the axilla support member includes a flat body having a rounded regular polygon shape.

7. The golf swing training aid rod of claim 1, wherein the axilla support member includes an oval shaped body and a curved surface.

8. The golf swing training aid rod of claim 7, wherein the oval shaped body and curved surface of the axilla support member has two sides including the inner bicep side and the axilla side.

9. The golf swing training aid rod of claim 1, wherein the inner bicep side has an inward curved surface and the axilla side has an outward curved surface to accommodate and complement the natural shape of the axilla member and the inner bicep of the golfer.

10. The golf swing training aid rod of claim 1, wherein the axilla support member includes a foam pad coupled to the inner bicep side of the axilla support member.

11. The golf swing training aid rod of claim 1, wherein the axilla support member includes a rotating ball joint connecting the attachment receiving member to the axilla support member, wherein the rotating ball joint provides a rotating mechanism.

12. The golf swing training aid rod of claim 1, wherein the axilla support member includes an arm band attachment.

13. The golf swing training aid rod of claim 12, wherein the axilla support member includes two arm band slots formed at each end of the axilla support member into which a portion of each end of the arm band attachment is inserted and secured thereon.

14. A golf swing and arm control training method using a golf swing training aid rod having an axilla support member coupled to an elongated shaft for providing a visual feedback and a tactile feedback to a golfer at a plurality of golf swing positions, the method comprising:

applying the axilla support member of the golf swing training aid rod to a trailing arm of the golfer between an inner bicep and an axilla member forming a first pressure point;

maintaining a first contact with the axilla support member of the golf swing training aid rod and the trailing arm at the first pressure point of the golfer at an address position;

maintaining the first contact with the axilla support member of the golf swing training aid rod and the trailing arm at the first pressure point of the golfer when the elongated shaft is parallel with a ground on a takeaway;

making an second contact with the elongated shaft of the golf swing training aid rod and a leading arm of the golfer at a second pressure point defined along a portion of the leading arm when the leading arm is parallel with the ground;

maintaining the first contact and the second contact with the golf swing training aid rod at the first pressure point of the trailing arm and the second pressure point of the leading arm at a top of a backswing position;

maintaining the first contact and the second contact with the golf swing training aid rod at the first pressure point of the trailing arm and the second pressure point of the leading arm when the leading arm is parallel with the ground on a downswing;

maintaining the first contact and the second contact with the golf swing training aid rod at the first pressure point of the trailing arm and the second pressure point of the leading arm when the elongated shaft is parallel with the ground on the downswing;

maintaining the first contact and the second contact with the golf swing training aid rod at the first pressure point of the trailing arm and the second pressure point of the leading arm at an impact position;

maintaining the first contact and the second contact with the golf swing training aid rod at the first pressure point of the trailing arm and the second pressure point of the leading arm when the elongated shaft is parallel with the ground on a follow-through;

maintaining the first contact and the second contact with the golf swing training aid rod at the first pressure point of the trailing arm and the second pressure point of the leading arm when the trailing arm is parallel with the ground on the follow-through; and maintaining the first contact with the golf swing training aid rod at the first pressure point while releasing the second contact at the second pressure point defined along a portion of the leading arm at a finish position, wherein the first pressure point and the second pressure point provide tactile feedback to the golfer.

15. The method of claim 14 further comprises visually monitoring a reference tip of the golf swing training aid rod for proper swing alignment at the plurality of golf swing positions.

16. A golf swing training aid rod for teaching a golfer a proper golf swing and positioning of a leading arm and a trailing arm of the golfer through visual and tactile feedback comprising:

an elongated shaft having a reference tip located at a first end of the elongated shaft and an attachment member located at a second end of the elongated shaft, wherein the first end is opposite to the second end; and an axilla support member having a flat body, an axilla side formed on a first side of the flat body, an inner bicep side formed on a second side of the flat body, and an attachment receiving member formed at one end of the flat body, wherein the attachment receiving member is coupled to the attachment member of the elongated shaft, wherein the axilla support member is configured to be applied to a first pressure point formed between an inner bicep and an axilla member of the trailing arm of the golfer, and wherein a portion of the elongated shaft is configured to be applied to a second pressure point on the leading arm, wherein the elongated shaft includes an illumination component and a contact switch formed on the elongated shaft, wherein the illumination component is applied and secured to a tip end of the elongated shaft and the contact switch is applied near a mid-point of the elongated shaft.

17. A golf swing training aid rod for teaching a golfer a proper golf swing and positioning of a leading arm and a trailing arm of the golfer through visual and tactile feedback comprising:

an elongated shaft having a reference tip located at a first end of the elongated shaft and an attachment member located at a second end of the elongated shaft, wherein the first end is opposite to the second end; and an axilla support member having a flat body, an axilla side formed on a first side of the flat body, an inner bicep side formed on a second side of the flat body, and an attachment receiving member formed at one end of the flat body, wherein the attachment receiving member is coupled to the attachment member of the elongated shaft, wherein the axilla support member is configured to be applied to a first pressure point formed between an inner bicep and an axilla member of the trailing arm of the golfer, and wherein a portion of the elongated shaft is configured to be applied to a second pressure point on the leading arm, wherein the axilla support member includes an arm band attachment, and wherein the axilla support member includes two arm band slots formed at each end of the axilla support member into which a portion of each end of the arm band attachment is inserted and secured thereon.

* * * * *